US005376515A

United States Patent [19]

Kume

[11] Patent Number: 5,376,515

[45] Date of Patent: Dec. 27, 1994

[54] SILVER HALIDE COLOR PHOTOGRAPHIC LIGHT-SENSITIVE MATERIAL

[75] Inventor: Yuji Kume, Minami-ashigara, Japan

[73] Assignee: Fuji Photo Film Co., Ltd., Kanagawa, Japan

[21] Appl. No.: 77,538

[22] Filed: Jun. 17, 1993

[30] Foreign Application Priority Data

Jun. 18, 1992 [JP] Japan ..... 4-182889

[51] Int. Cl.[5] ..... G03C 1/46

[52] U.S. Cl. ..... 430/506; 430/504; 430/505; 430/549; 430/553; 430/557; 430/957; 430/359

[58] Field of Search ..... 430/506, 504, 359, 362, 430/549, 553, 957, 557, 505, 544

[56] References Cited

U.S. PATENT DOCUMENTS 4,647,527 3/1987 Ikenoue et al. ..... 430/504
5,075,207 12/1991 Langen et al. ..... 430/549
5,112,730 5/1992 Ohkawa et al. ..... 430/504

FOREIGN PATENT DOCUMENTS 0456257 11/1991 European Pat. Off. .
1474994 5/1977 United Kingdom .

*Primary Examiner*—Charles L. Bowers, Jr.
*Assistant Examiner*—Geraldine Letscher
*Attorney, Agent, or Firm*—Sughrue, Mion, Zinn, Macpeak & Seas

[57] ABSTRACT

A silver halide color photographic light-sensitive material has, on a support, at least one green-sensitive silver halide emulsion layer containing a magenta coupler, at least one blue-sensitive silver halide emulsion layer containing a yellow coupler, and at least two red-sensitive silver emulsion layers containing a cyan coupler and having different sensitivities. The highest sensitivity layer of the red-sensitive silver halide emulsion layers contains a yellow coupler, and a red-sensitive emulsion layer having a lower sensitivity contains a yellow-colored cyan coupler.

13 Claims, No Drawings

SILVER HALIDE COLOR PHOTOGRAPHIC LIGHT-SENSITIVE MATERIAL

BACKGROUND OF THE INVENTION

1. Field of the Invention

The present invention relates to a color photographic light-sensitive material having a high sensitivity, a high sharpness, and an improved print quality.

2. Description of the Related Art

Recently, a demand has arisen for silver halide light-sensitive materials, particularly those for photographing, to have a high sensitivity, a high color reproducibility, and a high sharpness.

As a means for improving the color reproducibility and sharpness, use of compounds represented by formula (XI) used in the present invention, which will be described later in detail, is proposed in, for example, Unexamined Published Japanese Patent Application (hereinafter referred to as "JP-A") 60-185950, JP-A-61-233741, JP-A-62-151850, JP-A-63-163454 and 63-281160. These compounds enhance the interlayer effect and an edge effect, resulting in some improvement in the color reproducibility and sharpness. However, sufficient interlayer effect and edge effect can not be attained unless the development inhibitors are released from the compounds in an amount sufficient to inhibit the development, and a desirable interlayer effect can not be obtained unless light-sensitive layers to be inhibited of the development are developed to a proper degree. Therefore, sufficient effects can not be imparted to all the exposed regions, and the sensitivity is slightly lowered in obtaining such effects. Further, in a usual layer arrangement, in which a red-sensitive layer containing a cyan coupler, a green-sensitive layer containing a magenta coupler, and a blue-sensitive layer containing a yellow coupler are arranged on a support in the order mentioned from the support, the above-mentioned compounds can not exert sufficient interlayer effect between these layers, and the sensitivity of the green-sensitive layer is lowered, since the red-sensitive and blue-sensitive layers are too spaced apart from each other.

JP-A-61-221748 and West German Laid-Open Application 3815469A, for example, describe that it is possible to obtain an effect similar, in terms of photographic performance, to an interlayer effect from the red-sensitive layer to the blue-sensitive layer by using a yellow colored cyan coupler in the red-sensitive layer. However, the use of the couplers alone as described in these patent documents can not achieve a desired effect over the entire exposed regions. In addition, known yellow colored cyan couplers is small the molecular extinction coefficient of the yellow dyes formed therefrom, and has low coupling activity.

Further, JP-A-3-265845 discloses to add a yellow coupler to a red-sensitive layer in order to improve color reproducibility. This technique can correct an overburdened interimage effect to adjust the hue to some extent. However, the yellow coupler, if used in an excessive amount, lowers the saturation, which is not sufficient in improving the color reproducibility, and thus a satisfactory print quality can not be obtained.

SUMMARY OF THE INVENTION

An object of the invention is to provide a color photographic light-sensitive material having a high sensitivity, a high sharpness, and an improved print quality.

The above object of the invention can be achieved by a silver halide color photographic light-sensitive material comprising, on a support, at least one green-sensitive silver halide emulsion layer containing a magenta coupler, at least one blue-sensitive silver halide emulsion layer containing a yellow coupler, and at least two red-sensitive silver emulsion layers containing a cyan coupler and having different sensitivities, wherein, of said red-sensitive silver halide emulsion layers, a red-sensitive emulsion layer having a highest sensitivity contains a yellow coupler, and a red-sensitive emulsion layer having a lower sensitivity contains a yellow colored cyan coupler.

DETAILED DESCRIPTION OF THE PREFERRED EMBODIMENTS

The yellow coupler for use in the invention is preferably represented by the following formula (Y):

Formula (Y)

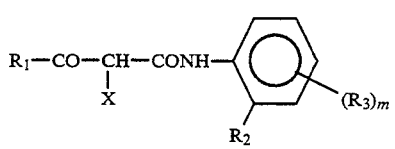

In the formula (Y), $R_1$ represents a tertiary alkyl group preferably having 4 to 36 carbon atoms, or an aryl group preferably having 6 to 36 carbon atoms; $R_2$ represents a hydrogen atom, a halogen atom (F, Cl, Br, or I; the same applies to the following explanation of the formula (Y)), an alkoxy group preferably having 1 to 36 carbon atoms, an aryloxy group preferably having 6 to 36 carbon atoms, an alkyl group preferably having 1 to 36 carbon atoms, or a dialkylamino group preferably having 2 to 36 carbon atoms, $R_3$ represents a group which can be substituted on the benzene ring, X represents a hydrogen atom, or a group (i.e., a split-off group) which can be split off upon coupling with an oxidized form of an aromatic primary amine developing agent; and m represents an integer of 0 to 4. If m is 2, 3 or 4, groups $R_3$ may be the same or different.

Examples of $R_3$ are a halogen atom, an alkyl group preferably having 1 to 36 carbon atoms, an aryl group preferably having 6 to 36 carbon atoms, an alkoxy group preferably having 1 to 36 carbon atoms, an aryloxy group preferably having 6 to 36 carbon atoms, an alkoxycarbonyl group preferably having 2 to 36 carbon atoms, an aryloxycarbonyl group preferably having 7 to 36 carbon atoms, a carbonamido group preferably having 1 to 36 carbon atoms, a sulfonamido group preferably having 1 to 36 carbon atoms, a carbamoyl group preferably having 1 to 36 carbon atoms, a sulfamoyl group preferably having 0 to 36 carbon atoms, an alkylsulfonyl group preferably having 1 to 36 carbon atoms, an arylsulfonyl group preferably having 6 to 36 carbon atoms, a ureido group preferably having 1 to 36 carbon atoms, a sulfamoylamino group preferably having 0 to 36 carbon atoms, an alkoxycarbonylamino group preferably having 2 to 36 carbon atoms, a nitro group, a heterocyclic group preferably having 1 to 36 carbon atoms, a cyano group, an acyl group preferably having 1 to 36 carbon atoms, an acyloxy group preferably having 1 to 36 carbon atoms, an alkylsulfonyloxy group preferably having 6 to 36 carbon atoms, and an arylsulfonyloxy group preferably having 6 to 36 carbon atoms. The examples of the split-off group are a heterocyclic group (preferably having 1 to 36 carbon atoms) bonded to the coupling active position through a nitrogen atom, an aryloxy group preferably having 6 to 36 carbon atoms, an arylthio group preferably having 6 to 36 carbon atoms, an acyloxy group preferably having 1 to 36 carbon atoms, an alkylsulfonyloxy group preferably having 1 to 36 carbon atoms, a heterocyclic oxy group preferably having 1 to 36 carbon atoms, and a halogen atom.

In the formula (Y), it is preferred that $R_1$ be t-butyl, phenyl, or a phenyl group substituted with a halogen atom, an alkyl group having 1 to 18 carbon atoms or an alkoxy group having 1 to 24 carbon atoms; $R_2$ be a halogen atom, an alkoxy group having 1 to 24 carbon atoms; or a phenoxy group having 6 to 36 carbon atoms; $R_3$ be a halogen atom, an alkoxy group having 1 to 24 carbon atoms; an alkoxycarbonyl group having 2 to 25 carbon atoms, a carbonamido group having 2 to 30 carbon atoms, a sulfonamido group having 1 to 30 carbon atoms, a carbamoyl group having 1 to 30 carbon atoms, or a sulfamoyl group having 0 to 30 carbon atoms: X be an aryloxy group having 6 to 30 carbon atoms or a 5- to 7-membered heterocyclic group, having 2 to 36 carbon atoms, which is bonded to the coupling active position through a nitrogen atom and which may further contain N, S, O, or P; and m be an integer of 0 to 2. The coupler represented by the formula (Y) may be a dimer, a polymer, a homopolymer, or a copolymer containing non-color-forming polymer units, in which substituent groups $R_1$, Xs, or groups specified below are bonded through a group having a valence of 2 or more:

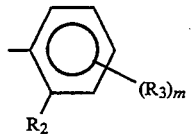

Specific examples of the coupler represented by the formula (Y) are as follows:

(Y1)

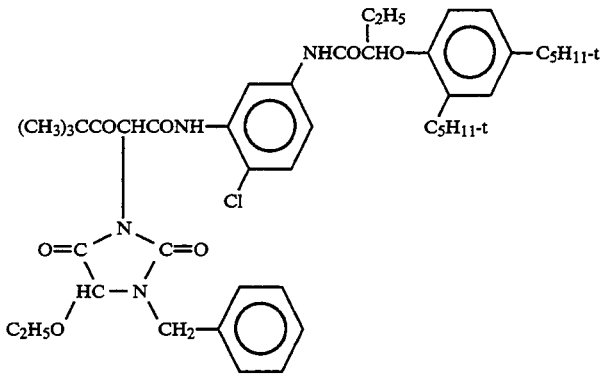

(Y2)

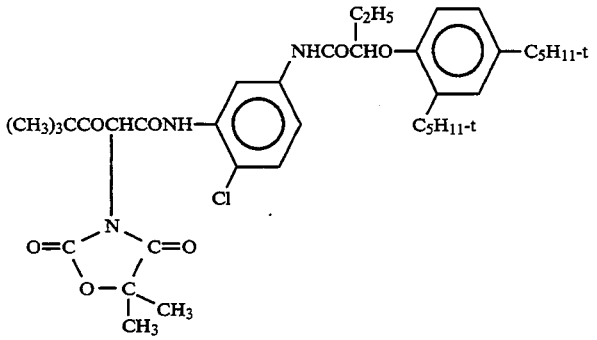

(Y3)

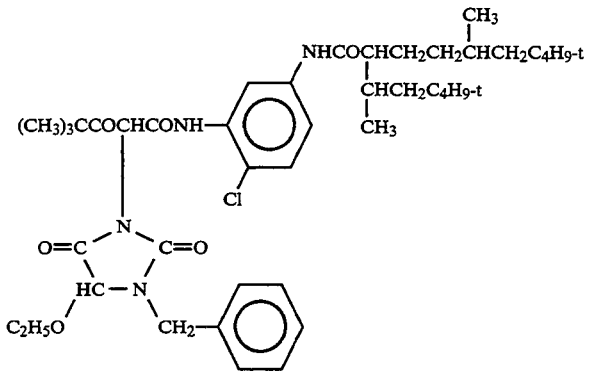

-continued
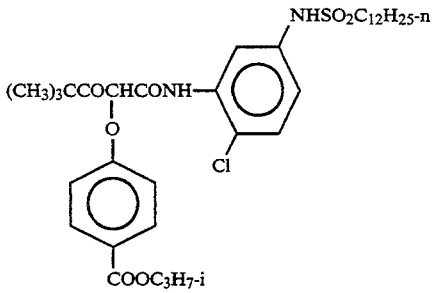
(Y4)
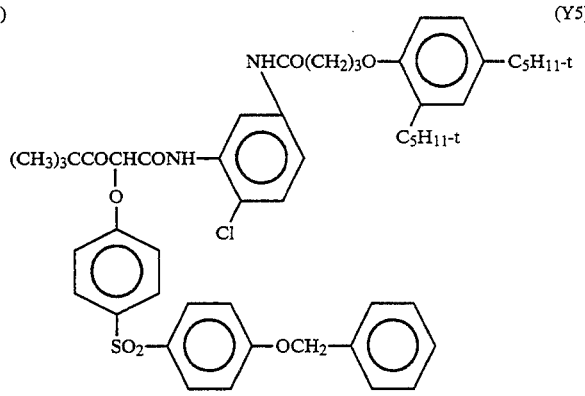
(Y5)
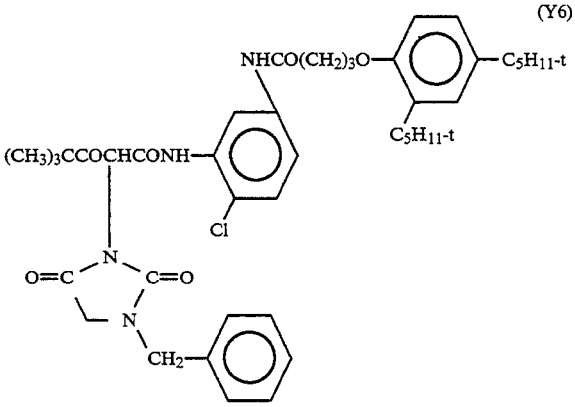
(Y6)
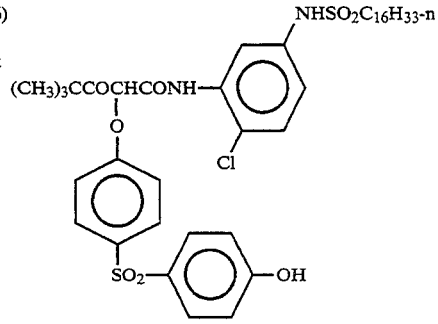
(Y7)
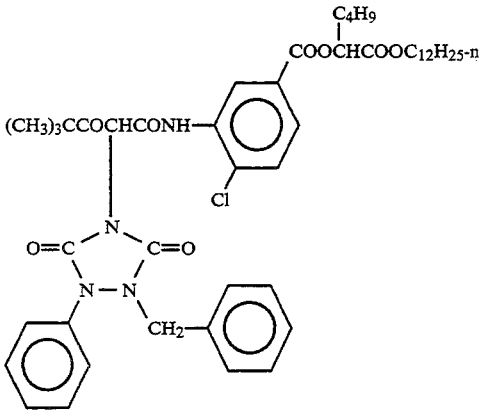
(Y8)
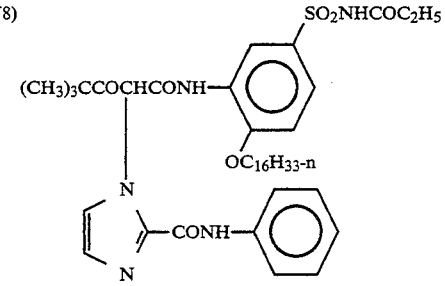
(Y9)
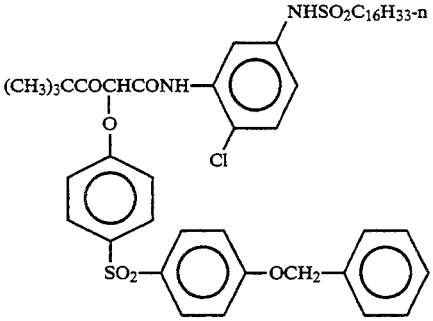
(Y10)
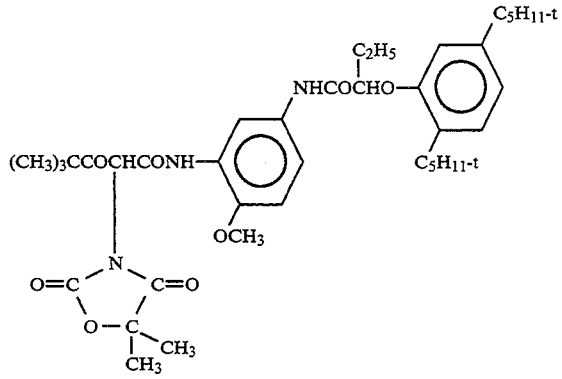
(Y11)

-continued

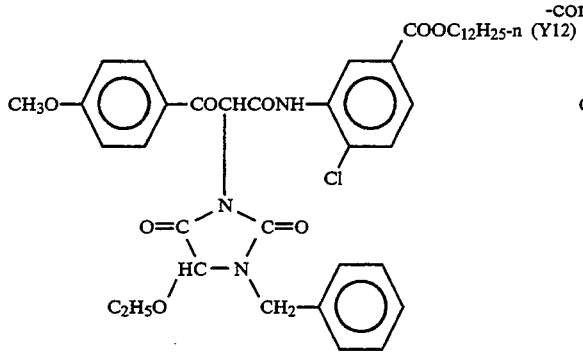

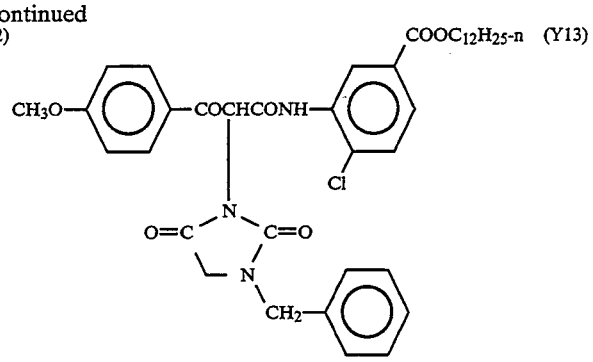

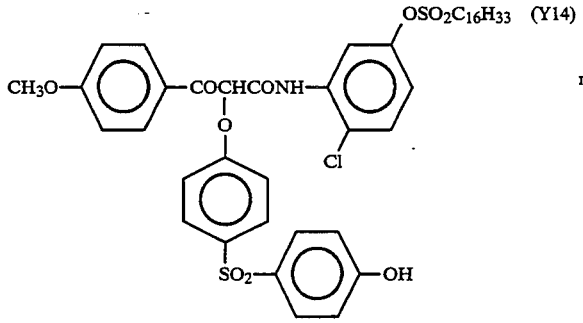

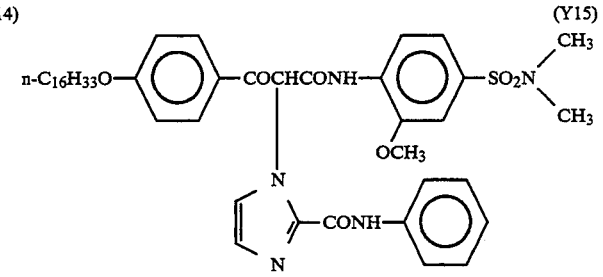

Yellow couplers other than those specified above, which can be used in the present invention, and/or methods of synthesizing the yellow couplers are described in, for example, U.S. Pat. Nos. 3,227,554; 3,408,194; 3,894,875; 3,933,501; 3,973,868; 4,022,620; 4,057,432; 4,115,121; 4,203,768; 4,248,961; 4,266,019; 4,314,023; 4,327,175; 4,401,752; 4,404,274; 4,420,556; 4,711,837 and 4,729,944, European Patents 30,747A, 284,081A, 296,793A and 313,308A, West German Patent 3,107,173C, JP-A-58-42044, JP-A-59-174839, JP-A-62-276547, and JP-A-63-123047.

Those yellow couplers which are represented by the following formulas (Y-2) and (Y-3) are also preferably used in the present invention.

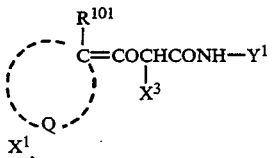

Formula (Y-2)

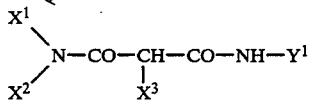

Formula (Y-3)

In formulas (Y-2) and (Y-3), Ar represents an aryl group, $R^{101}$ represents a substituent other than hydrogen, Q represents a non-metallic atomic group required to form a 3- to 5-membered hydrocarbon ring or a 3- to 5-membered heterocyclic ring, each of $X^1$ and $X^2$ represents an alkyl group, an aryl group, or a heterocyclic group, $X^3$ represents a hydrogen atom, or a group which can be split off upon reaction with an oxidized form of a color developing agent, and $Y^1$ represents an alkyl group, an aryl group or a heterocyclic group. $R^{101}$ may bond with Q, and $X^1$ and $X^2$ may combine together, forming a non-metallic atomic group required to form, together with N, a heterocyclic group.

In formula (Y-2), $R^{101}$ represents a monovalent substituent group other than hydrogen; and Q represents a non-metallic atomic group required to form, together with the C, either a 3- to 5-membered hydrocarbon ring, or a 3- to 5-membered heretocyclic group containing at least one heteroatom selected from N, S, O, and P in the ring.

$R^{101}$ is preferably a halogen atom, a cyano group, or a monovalent group having a total carbon number (to be abbreviated as C number hereinafter) of 1 to 30, which may be substituted (e.g., an alkyl group, an alkoxy group or alkylthio group), or a monovalent group having a C number of 6 to 30, which may be substituted (e.g. an aryl group, an aryloxy group or arylthio group). The substituent group thereof includes a halogen atom, an alkyl group, an alkoxy group, a nitro group, an amino group, a carbonamido group, a sulfonamido group, and an acyl group. $R^{101}$ is particulary preferably an alkyl group (e.g., methyl, ethyl, n-octyl, benzyl, hexadecyl or phenoxymethyl).

Q preferably represents a non-metallic atomic group required to form, together with the C, either a 3- to 5-membered hydrocarbon ring having a C number of 3 to 30, which may be substituted, or a heretocyclic group having a C number of 2 to 30, which contains at least one heteroatom selected from N, S, O, and P in the ring and which may be substituted. The ring which Q forms along with the C may contain an unsaturated bond in it. Examples of such a ring are a cyclopropane ring, a cyclobutane ring, a cyclopentane ring, a cyclopropene ring, a cyclobutene ring, a cyclopentene ring, an oxetane ring, an oxolane ring, a 1,3-dioxolane ring, a thietane ring, a thiolane ring, and a pyrrolidine ring. Examples of the substituent group are a halogen atom, a hydroxyl group, an alkyl group, an aryl group, an acyl group, an alkoxy group, an aryloxy group, a cyano group, an alkoxycarbonyl group, an alkylthio group and an arylthio group.

Combined with $R^{101}$, Q may-form, together with the C to which Q is bonded, a polycycloalkyl group including a bi- or higher-cycloalkyl group. Examples of such a polycycloalkyl group are a bicyclo[2,1,0]penten-1-yl group, a bicyclo[2,2,0]hexan-1-yl group, bicyclo[3,1,0-]hexan-1-yl group, a bicyclo[3,2,0]heptan-1-yl group, bicyclo[3,3,0]octan-1-yl group, a bicyclo[4,1,0]heptan-1-yl group, a bicyclo[4,2,0]octan-1-yl group, a bicyclo[4,3,0]nonan-1-yl group, a bicyclo[5,1,0]octan-1-yl group, a bicyclo[5,2,0]nonan-1-yl group, a bicyclo[1,1,1]pentan-1-yl group, a bicyclo[2,1,1]hexan-1-yl group, a bicyclo[2,2,1]heptan-1-yl group, a bicyclo[2,2,-2]octan-1-yl group, a tricyclo[3,1,1,$0^{3,6}$]heptan-6-yl group, a tricyclo[3,3,0,$0^{3,71}$]octan-1-yl group, and a tricyclo[3,3,1,$0^{3,7}$]nonan-3-yl group, all of which may be substituted. Examples of the substituents are those described above in the explanation of Q. The position of the substituent is, preferably, not $\alpha$-position ($\beta$-position to the carbonyl group to which the polycycloalkyl group is bonded).

The ring formed by Q with the C is preferably a 3- or 4-membered ring, more preferably 3-membered ring.

The ring formed by Q with the C is preferably a hydrocarbon ring.

Of the alkyl groups which Q and $R^{101}$ form together with the C, particularly preferred are a 1-alkylcyclopropan-1-yl group, a bicyclo[2,1,0]pentan-1-yl group, a bicyclo[3,1,0]hexan-1-yl group, bicyclo[4,1,0]heptan-1-yl group, a bicyclo[2,2,0]hexan-1-yl group, a bicyclo[1,1,1]pentan-1-yl group, a bicyclo[2,1,1]hexan-1-yl group, and tricyclo[3,1,1,$0^{3,6}$]heptan-6-yl group.

In formula (Y-3), when each of $X^1$ and $X^2$ represents an alkyl group, this alkyl group is a straight or branched chain or cyclic, saturated or unsaturated, substituted or unsubstituted alkyl group having 1 to 30 carbon atoms, preferably 1 to 20 carbon atoms. Examples of the alkyl group are methyl, ethyl, propyl, butyl, cyclopropyl, allyl, t-octyl, i-butyl, dodecyl, and 2-hexyldecyl.

When each of $X^1$ and $X^2$ represents a heterocyclic group, this heterocyclic group is a 3- to 12-memered, preferably 5- or 6-membered, saturated or unsaturated, substituted or unsubstituted, single-ring or fused-ring heterocyclic group having 1 to 20 carbon atoms, preferably 1 to 10 carbon atoms and containing at least one heteroatom selected from, e.g., a nitrogen atom, an oxygen atom and a sulfur atom. Examples of the heterocyclic group are 3-pyrrolidinyl, 1,2,4-triazol-3-yl, 2-pyridyl, 4-pyrimidinyl, 3-pyrazolyl, 2-pyrrolyl, 2,4-dioxo-1,3-imidazolidin-5-yl, and pyranyl.

When each of $X^1$ and $X^2$ represents an aryl group, this aryl group is a substituted or unsubstituted aryl group having 6 to 20 carbon atoms, preferably 6 to 10 carbon atoms. Typical examples of the aryl group are phenyl and naphthyl.

When $X^1$ and $X^2$ bond together to form, together with the N, a heterocyclic group, this heterocyclic group is a 3- to 12-membered, preferably 5- or 6-membered, substituted or unsubstituted, saturated or unsaturated, single-ring or fused-ring heterocylic group which has 1 to 20 carbon atoms, preferably 1 to 15 carbon atoms, and which may contain, e.g., an oxygen atom or a sulfur atom in addition to the nitrogen atom. Examples of the heterocyclic group are pyrrolidino, piperidino, morpholino, 1-piperadinyl, 1-indolinyl, 1,2,3,4-tetrahydroquinolin-1-yl, 1-imidazolidinyl, 1-pyrazolyl, 1-pyrrolinyl, 1-pyrazolidinyl, 2,3-dihydro-1-indazolyl, 2-isoindolynyl, 1-indolyl, 1-pyrrolyl, 4-thiazine-s,s-dioxo-4-yl, and benzoxadin-4-yl.

$X^1$ and $X^2$ may be substituted. Examples of the substituent are a halogen atom, a cyano group, an acyl group, an alkoxycarbonly group, a sulfonyl group, an alkoxy group, an aryloxy group, an alkyl group, an aryloxy group, a carbonamido group, and a sulfonamido group.

Of the groups represented by $X^1(X^2)N$—, a group in which $X^1$ and $X^2$ bond together is preferable, and a 1-indonyl group is more preferable.

In formulas (Y-2) and (Y-3), $Y^1$ is preferably an aryl group, and more preferably a group represented by the following formula (Y-4).

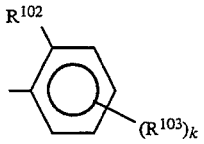

Formula (Y-4)

In formula (Y-4), $R^{102}$ represents a hydrogen atom, an alkyl group, an alkoxy group, an aryloxy group or an amino group, $R^{103}$ represents a group substitutable on the benzene ring, and k represents an integer of 0 to 4. When k is 2 or more, 2 or more groups $R^{103}$ may be the same or different.

In formula (Y-4), $R^{102}$ preferably represents a halogen atom; or an alkoxy group having a C number of 1 to 30, an aryloxy group having a C number of 6 to 30, an alkyl group having a C number of 1 to 30, or an amino group having a C number of 0 to 30, all of which may be substituted. Examples of the substituent are a halogen atom, an alkyl group, an alkoxy group, and an aryloxy group.

In formula (Y-4), $R^{103}$ preferably represents a halogen atom; or an alkyl group having a C number of 1 to 30, an aryl group having a C number of 6 to 30, an alkoxy group having a C number of 1 to 30, an alkoxycarbonyl group having a C number of 2 to 30, an aryloxycarbonyl group having a C number of 7 to 30, a carbonamido group having a C number of 1 to 30, a sulfonamido group having a C number of 1 to 30, a carbamoyl group having a C number of 1 to 30, a sulfamoyl group having a C number of 0 to 30, an alkylsulfonyl group having a C number of 1 to 30, an arylsulfonyl group having a C number of 6 to 30, a ureido group having a C number of 1 to 30, a sulfamoylamino group having a C number of 0 to 30, an alkoxycarbonylamino group having a C number of 2 to 30, a heterocyclic group having a C number of 1 to 30, an acyl group having a C number of 1 to 30, an alkylsulfonyloxy group having a C number of 1 to 30 or an arylsulfonyloxy group having a C number of 6 to 30, all of which may be substituted. Examples of the substituent are a halogen atom, an alkyl group, an aryl group, a heterocyclic group, an alkoxy group, an aryloxy group, a heterocyclic oxy group, an alkylthio group, an arylthio group, a heterocyclic thio group, an alkylsulfonyl group, an arylsulfonyl group, an acyl group, a carbonamido group, a sulfonamido group, a carbamoyl group, a sulfamoyl group, an alkoxycarbonylamino group, a sulafmoylamino group, a ureido group, a cyano group, a nitro group, an acyloxy group, an alkoxycarbonyl group, an aryloxycarbonyl group, an alkylsulfonyloxy group, and an arylsulfonyloxy group.

In formula (Y-4), k is preferably an integer of 1 or 2, and the substitution position of $R^{103}$ is preferably meta or para to the acylacetamido group.

In formulas (Y-2) and (Y-3), $X^3$ is preferably a heterocyclic group which bonds to the coupling active position through a nitrogen atom, or an aryloxy group.

When $X^3$ represents a heterocyclic group, $X^3$ is preferably selected from an imidazolidin-2,4-dion-3-yl group, an oxazolin-2,4-dion-3-yl group, a 1,2,4-triazin-3,5-dion-4-yl group, a succinimido group, a 1-pyrazolyl group and a 1-imidazolyl group, all of which may be substituted.

When $X^3$ represents an aryloxy group, $X^3$ is preferably an aryloxy group substituted with at least one electron-attracting substituent. Examples of the substituent are a halogen atom, a cyano group, a nitro group, a trifluoromethyl group, an acyl group, an alkylsulfonyl group, an arylsulfonyl group, an alkoxycarbonyl group, a carbamoyl group, and a sulfamoyl group.

$X^3$ is particularly preferably a 5-membered heterocyclic group described above.

The couplers represented by formulas (Y-2) and (Y-3) may combine with each other directly or through a group having a valence of 2 or more, at the substituent represented by $R^{101}$, $X^1$, $X^2$, $Y^1$, Q or $X^3$, to form a dimer or a higher polymer. In this case, the carbon number may be out of the range specified for each of the above-described substituent groups.

Specific examples of the yellow couplers represented by formulas (Y-2) and (Y-3) are listed below:

(Y-2-1)

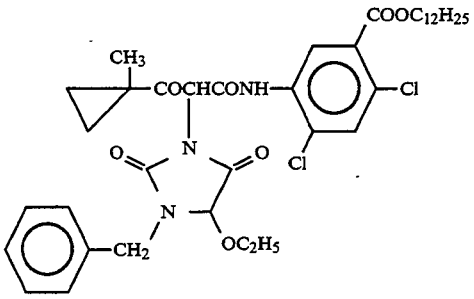

(Y-2-2)

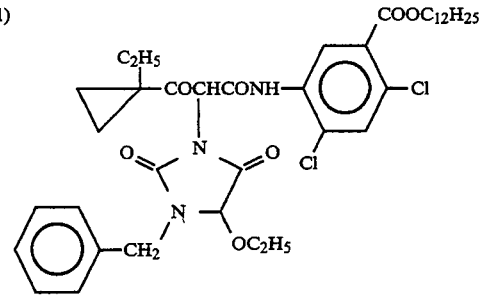

(Y-2-3)

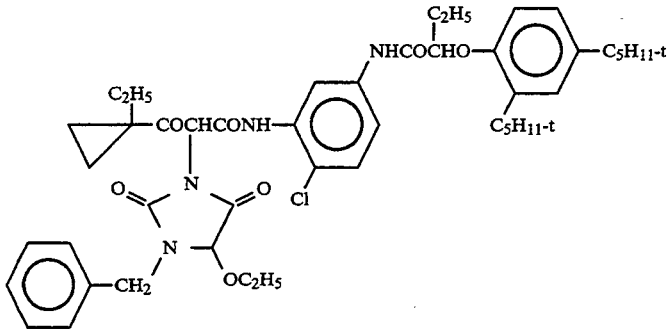

(Y-2-4)

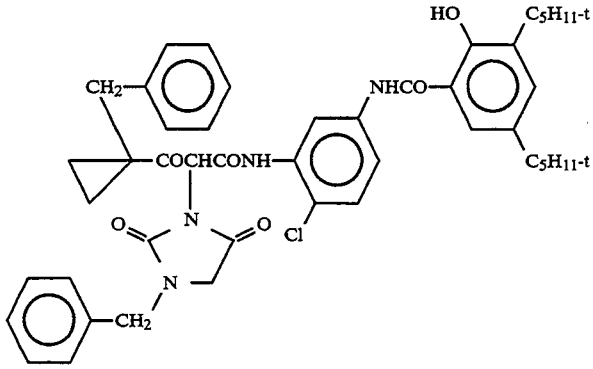

(Y-2-5)

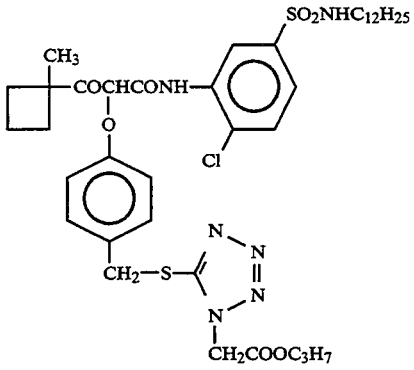

-continued
(Y-2-6)
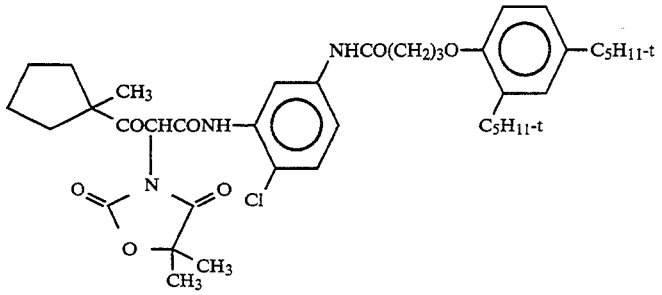
(Y-2-7)
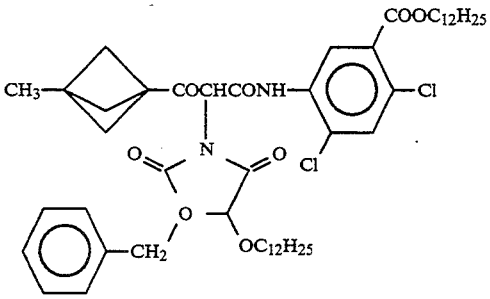
(Y-2-8)
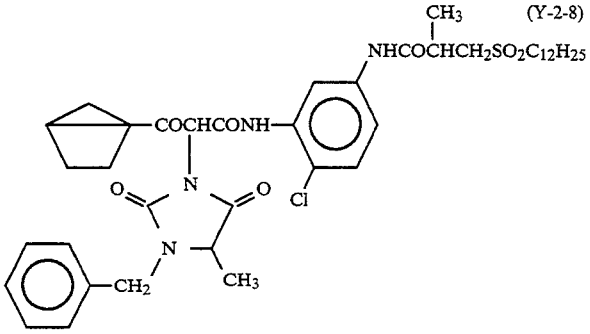
(Y-2-9)
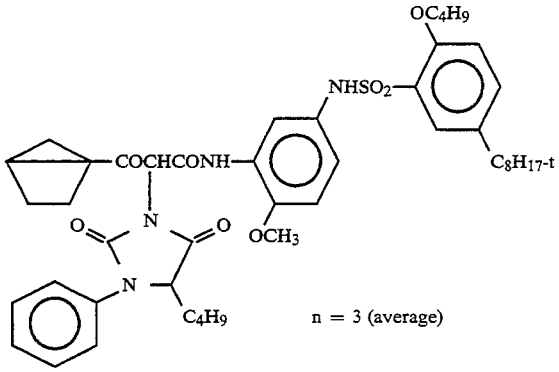
n = 3 (average)
(Y-2-10)
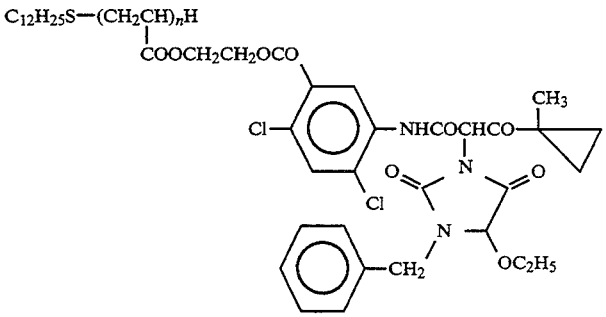
(Y-3-1)
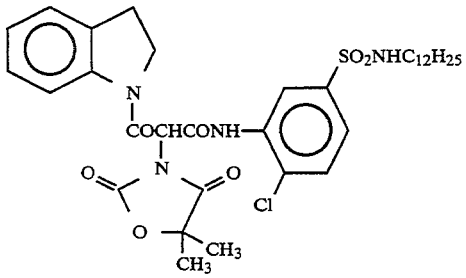
(Y-3-2)
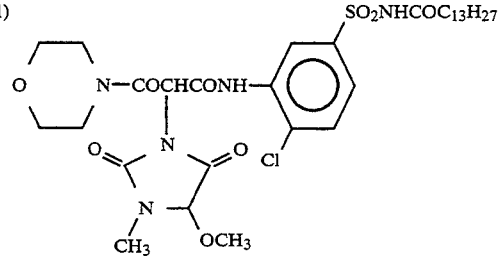

-continued
(Y-3-3)
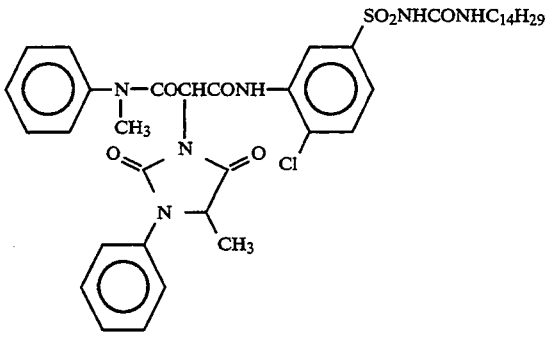
(Y-3-4)
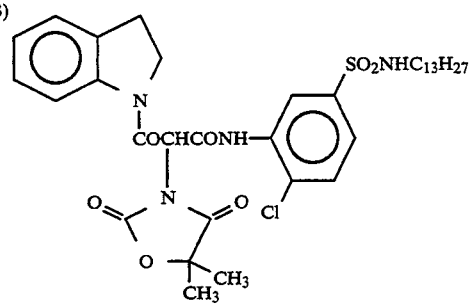
(Y-3-5)
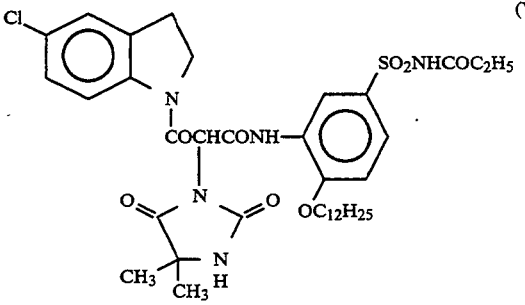
(Y-3-6)
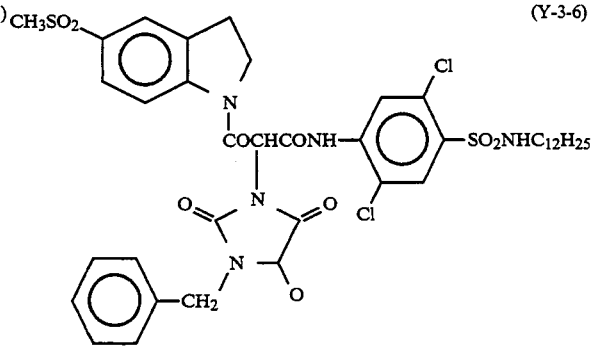
(Y-3-7)
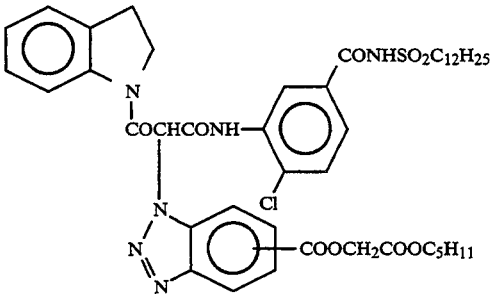
(Y-3-8)
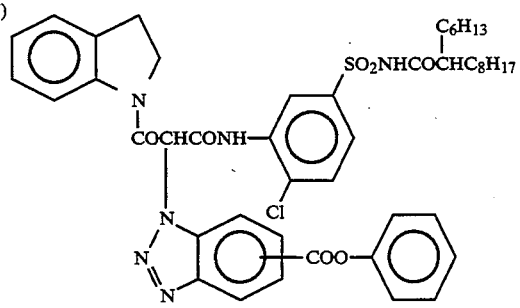
(Y-3-9)
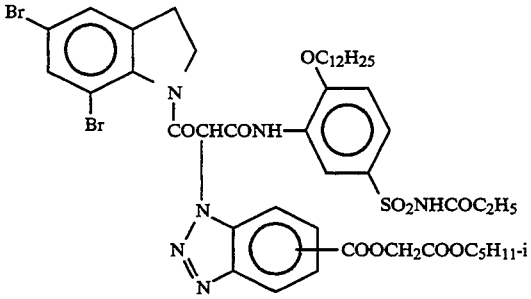
(Y-3-10)
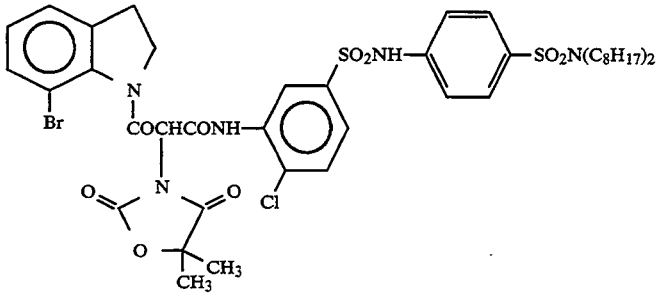
The yellow coupler added to the highest sensitivity layer of the red-sensitive layers is preferably the coupler Next, the yellow colored cyan couplers used in the present invention will be described in detail.

The yellow colored cyan couplers used in the present invention have the absorption maximum at 400 nm to 500 nm in the visible absorption region of the coupler, and form, upon reaction with the oxidized form of an aromatic primary amine developing agent, a cyan dye having the absorption maximum at 630 nm to 750 nm in the visible absorption region.

Those yellow colored cyan coupler which can release, upon reaction with the oxidized form of an aromatic primary amine developing agent, a residue containing a water-soluble 6-hydroxy-2-pyridon-5-ylazo group, a water-soluble pyrazolon-4-ylazo group, a water-soluble 2-acylaminophenylazo group or a water-soluble 2-sulfonamidophenylazo group are preferably used in the present invention.

The yellow colored cyan coupler used in the present invention are preferably represented by the following formulas (CI) to (CIV):

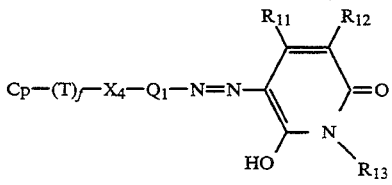
Formula (CI)

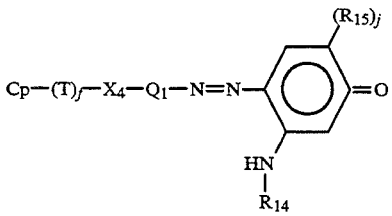
Formula (CII)

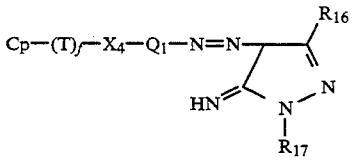
Formula (CIII)

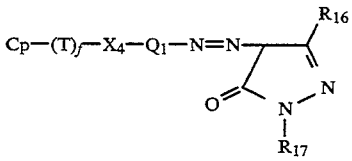
Formula (CIV)

In formulas (CI) to (CIV), Cp represents a cyan coupler residue, T represents a timing group bonded to the coupling position of Cp, f represents an integer of 0 or 1, $X_4$ represents a divalent linking group containing N, O or S through which it is bonded to $(T)_f$, and bonding to $Q_1$, and $Q_1$ represents an arylene group or a divalent heterocyclic group.

In formula (CI), each of $R_{11}$ and $R_{12}$ independently represents a hydrogen atom, a sulfo group, a cyano group, an alkyl group, a cycloalkyl group, an aryl group, a heterocyclic group, a carbamoyl group, a carbonamido group, a sulfonamido group, or an alkylsulfonyl group, and $R_{13}$ represents a hydrogen atom, an alkyl group, an aryl group, or a heterocyclic group. At least one of T, $X_4$, $Q_1$, $R_{11}$, $R_{12}$ and $R_{13}$ contains a water-soluble group (e.g., hydroxy, carboxyl, sulfo, amino, ammoniumyl, phosphono, phosphino and hydroxysulfonyloxy groups).

Note that it is common sense that the group, in formula (CI), represented by the following formula:

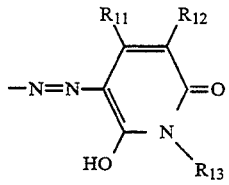

can take the following tautomeric forms, and these structures are also within the scope of formula (CI):

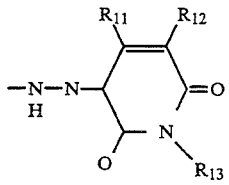

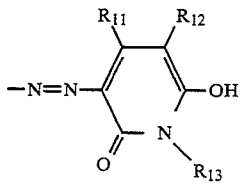

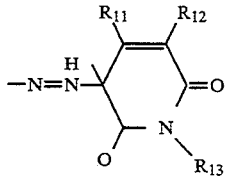

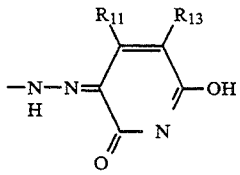
(when $R_{13}$ is a hydrogen atom)

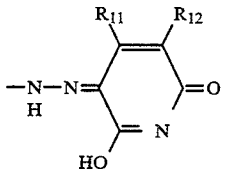
(when $R_{13}$ is a hydrogen atom)

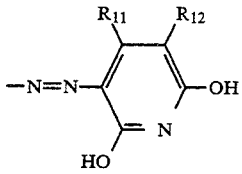
(when $R_{13}$ is a hydrogen atom)

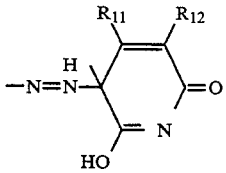
(when $R_{13}$ is a hydrogen atom)

In formula (CII), $R_{14}$ represents an acyl group or a sulfonyl group, $R_{15}$ represents a group substitutable on the benzene ring, and j represents an integer of 0 to 4. If j is 2 or more, 2 or more $R_{15}$ groups may be the same or different. At least one of T, $X_4$, $Q_1$, $R_{14}$ and $R_{15}$ contains a water-soluble group (e.g., hydroxy, carboxyl, sulfo, phosphono, phosphino, hydroxysulfonyloxy, amino, ammoniumyl groups).

In formulas (CIII) and (CIV), $R_{16}$ represents a hydrogen atom, a carboxyl group, a sulfo group, a cyano group, an alkyl group, a cycloalkyl group, an aryl group, an alkoxy group, a cycloalkyloxy group, an aryloxy group, a heterocyclic group, a carbamoyl group, a sulfamoyl group, a carbonamido group, a sulfonamido group, or an alkylsulfonyl group, and $R_{17}$ represents a hydrogen atom, an alkyl group, a cycloalkyl group, an aryl group, or a heterocyclic group. At least one of T, $X_4$, $Q_1$, $R_{16}$, and $R_{17}$ contains a water-soluble group (e.g., hydroxy, carboxyl, sulfo, phosphono, phosphino, hydroxysulfonyloxy, amino, ammoniumyl groups).

Note that:

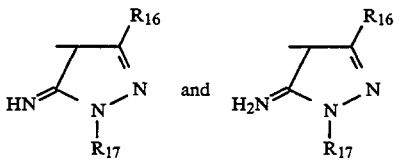

are in tautomeric relationship and are thus the same group, and

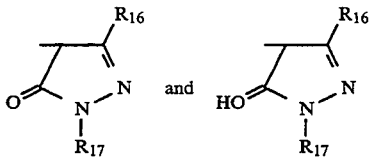

are in tautomeric relationship and are thus the same group.

The compounds represented by formulas (CI) to (CIV) will be described in more detail below.

The cyan coupler residue represented by Cp includes a residue of a known cyan coupler (e.g., a phenol-type or a naphthol-type cyan coupler).

The timing group represented by T is a group which is cleaved from $X_4$ after the bond with Cp is cleaved upon a coupling reaction of the coupler represented by formula (CI), (CII), (CIII) or (CIV) with the oxidized form of an aromatic primary amine developing agent. The timing group are used for various purposes such as control of the coupling reactivity, stabilization of the coupler, or control of release timing of the groups of $X_4$ et seq. Examples of the timing group are known linking groups represented by the following formulas (T-1) to (T-7), in which mark * indicates the bonding position with Cp, and mark ** indicates the bonding position with $X_4$.

(T-1)

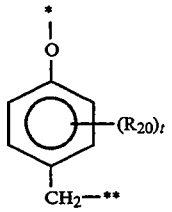

-continued (T-2)

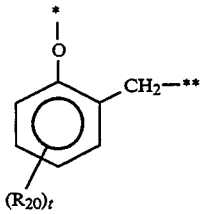

(T-3)

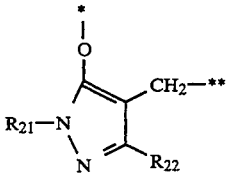

(T-4)

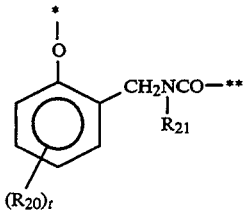

(T-5)

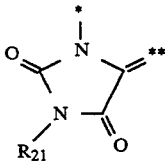

*—$OCH_2$—* (T-6)

(T-7)

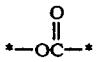

In formulas (T-1) to (T-7), $R_{20}$ represents a group substitutable on the benzene ring, $R_{21}$ represents $R_{41}$ which will be explained hereinafter, $R_{22}$ represents a hydrogen atom or a substituent, and t represents an integer of 0 to 4. Examples of the substituent represented by $R_{20}$ or $R_{22}$ are $R_{41}$, a halogen atom, $R_{43}O$—, $R_{43}S$—, $R_{43}(R_{44})NCO$—, $R_{43}OOC$—, $R_{43}SO_2$—, $R_{43}(R_{44})NSO_2$—, $R_{43}CON(R_{43})$—, $R_{42}SO_2N(R_{43})$—, $R_{43}CO$—, $R_{41}COO$—, $R_{41}SO$—, nitro, $R_{43}(R_{44})NCON(R_{45})$—, cyano, $R_{43}OCON(R_{43})$—, $R_{43}OSO_2$—, $R_{43}(R_{44})N$—, $R_{43}(R_{44})NSO_2N(R_{45})$—, and a group represented by the following formula:

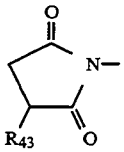

In the above description, $R_{41}$ represents an aliphatic group, an aromatic group, or a heterocyclic group, and each of $R_{43}$, $R_{44}$ and $R_{45}$ represents a hydrogen atom, an aliphatic group, an aromatic group, or a heterocyclic group.

In the above description, the aliphatic group is a saturated or unsaturated, chain or cyclic, straight or branched, substituted or unsubstituted aliphatic group having 1 to 32, preferably 1 to 22 carbon atoms. Typical examples are methyl, ethyl, propyl, isopropyl, butyl, t-butyl, i-butyl, t-amyl, hexyl, cyclohexyl, 2-ethylhexyl, octyl, 1,1,3,3-tetramethylbutyl, decyl, dodecyl, n-hexadecyl, and octadecyl.

The aromatic group has 6 to 20 carbon atoms, and is preferably a substituted or unsubstituted phenyl, or a substituted or unsubstituted naphthyl.

The heterocyclic group is a substituted or unsubstituted, preferably 3- to 8-membered, hetrocyclic group having 1 to 20, preferably 1 to 7 carbon atoms, and containing a heteroatom selected from nitrogen, oxygen and sulfur atoms. Typical examples of the heterocyclic group are 2-pyridyl, 2-thienyl, 2-furyl, 1,3,4-thiadiazol-2-yl, 2,4-dioxo-1,3-imidazolidin-5-yl, 1,2,4-triazol-2-yl, and 1-pyrazolyl.

When the above-listed aliphatic group, aromatic group, or heterocyclic group has a substituent, typical examples of the substituent are a halogen atom, $R_{47}O$—, $R_{46}S$—, $R_{47}CO(R_{48})N$—, $R_{47}(R_{48})NCO$—, $R_{46}SO_2N(R_{47})$—, $(R_{47})(R_{48})NSO_2$—, $R_{46}SO_2$—, $R_{47}O$-CO—, $(R_{47})(R_{48})NCON(R_{49})$—, a group of the same meaning as $R_{46}$, $R_{46}COO$—, $R_{47}OSO_2$—, a cyano group, a nitro group, and a group indicated below:

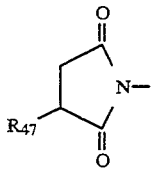

$R_{46}$ represents an aliphatic group, an aromatic group, or a heterocyclic group, and each of $R_{47}$ and $R_{48}$ represents an aliphatic group, an aromatic group, a heterocyclic group, or a hydrogen atom. The meanings of the aliphatic group, aromatic group, and heterocyclic group are the same as those defined before.

In formulas (CI) to (CIV), f represents an integer of 0 or 1. In general, f is preferably 0, i.e., Cp preferably combines directly with $X_4$.

$X_4$ is a divalent linking group which combines with Cp—$(T)_f$— by N, O, or S. Preferable examples of $X_4$ are —O—, —S—, —OCO—, —OCO(O)—, —OCO(S)—, —OCONH—, —$SO_2$—, —$OSO_2NH$—; a heterocyclic group which combines with Cp—$(T)_f$— by N (e.g., a group derived from pyrrolidine, piperidine, morpholine, piperazine, pyrrole, pyrazole, imidazole, 1,2,4-triazole, benzotriazole, succinimide, phthalimide, oxazolidin-2,4-dione, imidazolidin-2,4-dione, or 1,2,4-triazolidin-3,5-dione), and a linking group which is a composite group of the above group with an alkylene group (e.g., methylene, ethylene, or propylene), a cylcoalkylene group (e.g., 1,4-cyclohexylene), an arylene group (e.g., o-phenylene or p-phenylene), a divalent heterocyclic group e.g., a group derived from pyridine or thiophene), —CO—, —$SO_2$—, —COO—, —CONH—, —$SO_2NH$—, —$SO_2O$—, —NHCO—, —$NHSO_2$—, —NHCONH—, —$NHSO_2NH$— or —NHCOO—. $X_4$ is more preferably represented by Formula (I) below:

$$*—X_5—(L—X_6)_r—** \qquad \text{Formula (I)}$$

where symbol * represents the bonding position with Cp—$(T)_f$—, symbol ** represents the bonding position with Q et. seq., $X_5$ represents —O— or —S—, L represents an alkylene group, $X_6$ represents —O—, —S—, —CO—, —$SO_2$—, —OCO—, —COO—, —NHCO—, —CONH—, —$SO_2NH$—, —$NHSO_2$—, —$SO_2O$—, —$OSO_2$—, —OCO(O)—, —OCONH—, —NHCOO—, —NHCONH—, —$NHSO_2NH$—, —OCO(S)—, —S-CO(O)—, —$OSO_2NH$—, or —$NHSO_2O$—, and r represents an integer of 0 to 3.

The total number of carbon atoms, a C number, of $X_4$ is preferably 0 to 12, and more preferably 0 to 8. $X_4$ is most preferably —$OCH_2CH_2O$—.

In formulas ((I) to (CIV)), $Q_1$ represents an arylene group or a divalent heterocyclic group. When $Q_1$ is an arylene group, this arylene group may be a condensed ring or have a substituent (e.g., a halogen atom, hydroxyl, carboxyl, sulfo, nitro, cyano, amino, ammonium, phosphono, phosphino, alkyl, cycloalkyl, aryl, carbonamido, sulfonamido, alkoxy, aryloxy, acyl, sulfonyl, carboxyl, carbamoyl, or sulfamoyl), and its C number is preferably 6 to 15, and more preferably 6 to 10. When $Q_1$ is a divalent heterocyclic group, this heterocyclic group is a 3- to 8-membered, preferably 5- to 7-membered, single-ring or fused-ring heterocyclic group (e.g., a group derived from pyridine, thiophene, furan, pyrrole, pyrazole, imidazole, thiazole, oxazole, benzothiazole, benzoxazole, benzofuran, benzothiophene, 1,3,4-thiadiazole, indole, or quinoline) which contains at least one heteroatom selected from N, O, S, P, Se, and Te in its ring and may have a substituent (the same as the substituents when Q is an arylene group), and its C number is preferably 2 to 15, and more preferably 2 to 10. $Q_1$ is most preferably a group represented by:

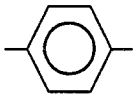

In the present invention, therefore, the most preferable —$(T)_f$—$X_4$—$Q_1$— is a group indicated below:

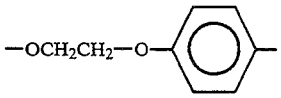

When $R_{11}$, $R_{12}$, or $R_{13}$ is an alkyl group, this alkyl group may be either straight-chain or branched, may contain an unsaturated bond, and may have a substituent (e.g., a halogen atom, hydroxyl, carboxyl, sulfo, phosphono, phosphino, cyano, alkoxy, aryl, alkoxycarbonyl, amino, ammoniumyl, acyl, carbonamido, sulfonamido, carbamoyl, sulfamoyl, or sulfonyl).

When $R_{11}$, $R_{12}$, or $R_{13}$ is a cycloalkyl group, this cycloalkyl group is a 3- to 8-membered cycloalkyl group which may have a bridging group, may contain an unsaturated bond, and may have a substituent (the same as the substituents when $R_{11}$, $R_{12}$, or $R_{13}$ is an alkyl group).

When $R_{11}$, $R_{12}$, or $R_{13}$ is an aryl group, this aryl group may be a condensed ring and may have a substituent (e.g., alkyl or cycloalkyl, in addition to the substituents when $R_{11}$, $R_{12}$, or $R_{13}$ is an alkyl group).

When $R_{11}$, $R_{12}$, or $R_{13}$ is a heterocyclic group, this heterocyclic group is a 3- to 8-membered, preferably 5- to 7-membered, single-ring or fused-ring heterocyclic group (e.g., imidazolyl, thienyl, pyrazolyl, thiazolyl, pyridyl, or quinolinyl) containing at least one heteroatom selected from N, S, O, P, Se, and Te in its ring, which may have a substituent (the same as the substituents when $R_{11}$, $R_{12}$, or $R_{13}$ is an aryl group).

In this case, a carboxyl group, a sulfo group, a phosphino group, and a phosphono group may include a carboxylato group, a sulfonato group, a phosphinato group, and a phosphonato group, respectively, and counter ions in this case are, for example, $Li^+$, $Na^+$, $K^+$, and ammonium.

$R_{11}$ is preferably a hydrogen atom, a carboxyl group, an alkyl group having a C number of 1 to 10 (e.g., methyl, t-butyl, sulfomethyl, 2-sulfoethyl, carboxymethyl, 2-carboxyethyl, 2-hydroxyethyl, benzyl, ethyl, or isopropyl), or an aryl group having a C number of 6 to 12 (e.g., phenyl, 4-methoxyphenyl, or 4-sulfophenyl), and most preferably a hydrogen atom, methyl, or carboxyl.

$R_{12}$ is preferably a cyano group, a carboxyl group, a carbamoyl group having a C number of 1 to 10, a sulfamoyl group having a C number of 0 to 10, a sulfo group, an alkyl group having a C number of 1 to 10 (e.g., methyl or sulfomethyl), a sulfonyl group having a C number of 1 to 10 (e.g., methylsulfonyl or phenylsulfonyl), a carbonamido group having a C number of 1 to 10 (e.g., acetamido or benzamido), or a sulfonamido group having a C number of 1 to 10 (e.g., methanesulfonamido or toluenesulfonamido), and most preferably a cyano group, a carbamoyl group, or a carboxyl group.

$R_{13}$ is preferably a hydrogen atom, an alkyl group having a C number of 1 to 12 (e.g., methyl, sulfomethyl, carboxymethyl, 2-sulfoethyl, 2-carboxyethyl, ethyl, n-butyl, benzyl, or 4-sulfobenzyl), or an aryl group having a C number of 6 to 15 (e.g., phenyl, 4-carboxyphenyl, 3-carboxyphenyl, 4-methoxyphenyl, 2,4-dicarboxyphenyl, 2-sulfophenyl, 3-sulfophenyl, 4-sulfophenyl, 2,4-disulfophenyl, or 2,5-disulfophenyl), and more preferably an alkyl group having a C number of 1 to 7 or an aryl group having a C number of 6 to 10.

Practical examples of $R_{14}$ are an acyl group represented by Formula (II) and a sulfonyl group represented by Formula (III):

$R_{31}CO$— Formula (II)

$R_{31}SO_2$— Formula (III)

When $R_{31}$ is an alkyl group, this alkyl group may be either straight-chain or branched, may contain an unsaturated bond, and may have a substituent (e.g., a halogen atom, hydroxyl, carboxyl, sulfo, phosphono, phosphino, cyano, alkoxy, aryl, alkoxycarbonyl, amino, ammoniumyl, acyl, carbonamido, sulfonamido, carbamoyl, sulfamoyl, or sulfonyl).

when $R_{31}$ is a cycloalkyl group, this cycloalkyl group is a 3- to 8-membered cycloalkyl group which may have a bridging group, an unsaturated bond, and a substituent (the same as the substituents when $R_{31}$ is an alkyl group).

When $R_{31}$ is an aryl group, this aryl group may be a condensed ring and have a substituent (e.g., alkyl or cycloalkyl, in addition to the substituents when $R_{31}$ is an alkyl group).

When $R_{31}$ is a heterocyclic group, this heterocyclic group is a 3- to 8-membered, preferably 5- to 7-membered, single-ring or fused-ring heterocyclic group (e.g., imidazolyl, thienyl, pyrazolyl, thiazolyl, pyridine, or quinolinyl) containing at least one heteroatom selected from N, S, O, P, Se, and Te, which may have a substituent (the same as the substituents when $R_{31}$ is an aryl group).

In this case, a carboxyl group, a sulfo group, a phosphino group, and a phosphono group may include a carboxylato group, a sulfonato group, a phosphinato group, and a phosphonato group, respectively, and counter ions in this case are, for example, $Li^+$, $Na^+$, $K^+$, and ammonium.

$R_{31}$ is preferably an alkyl group having a C number of 1 to 10 (e.g., methyl, carboxymethyl, sulfoethyl, or cyanoethyl), a cycloalkyl group having a C number of 5 to 8 (e.g., cyclohexyl or 2-carboxycyclohexyl), or an aryl group having a C number of 6 to 10 (e.g., phenyl, 1-naphthyl, or 4-sulfophenyl), and most preferably an alkyl group having a C number of 1 to 3 or an aryl group having a C number of 6.

$R_{15}$ is a substitutable group, preferably an electron-donating group, and most preferably —$NR_{32}R_{33}$ or —$OR_{34}$. The substitution position is preferably 4-position. Each of $R_{32}$, $R_{33}$, and $R_{34}$ is a hydrogen atom, an alkyl group, a cycloalkyl group, an aryl group, or a heterocyclic group, like $R_{31}$. A ring may be formed between $R_{32}$ and $R_{33}$, and an alicyclic ring is preferable as the nitrogen-containing heterocyclic ring formed.

j represents an integer of 0 to 4, preferably 1 or 2, and most preferably 1.

When $R_{16}$ or $R_{17}$ is an alkyl group, this alkyl group may be either straight-chain or branched, may contain an unsaturated bond, and may have a substituent (e.g., a halogen atom, hydroxyl, carboxyl, sulfo, phosphono, phosphino, cyano, alkoxy, aryl, alkoxycarbonyl, amino, ammoniumyl, acyl, carbonamide, sulfonamide, carbamoyl, sulfamoyl, or sulfonyl).

When $R_{16}$ or $R_{17}$ is a cycloalkyl group, this cycloalkyl group is a 3- to 8-membered cycloalkyl group which may have a bridging group, an unsaturated bond, and a substituent (the same as the substituents when $R_{16}$ or $R_{17}$ is an alkyl group).

When $R_{16}$ or $R_{17}$ is an aryl group, this aryl group may be a condensed ring and have a substituent (e.g., alkyl or cycloalkyl, in addition to the substituents when $R_{16}$ or $R_{17}$ is an alkyl group).

When $R_{16}$ or $R_{17}$ is a heterocyclic group, this heterocyclic group is a 3- to 7-membered, preferably 5- to 6-membered, single-ring or fused-ring heterocyclic group containing at least one heteroatom selected from N, S, O, P, Se, or Te in its ring (e.g., imidazolyl, thienyl, pyrazolyl, thiazolyl, pyridyl, or quinolinyl), which may have a substituent (the same as the substituents when $R_{16}$ or $R_{17}$ is an aryl group).

In this case, a carboxyl group, a sulfo group, a phosphino group, and a phosphono group may include a carboxylato group, a sulfonato group, a phosphinato group, and a phosphonato group, respectively, and counter ions in this case are, for example, $Li^+$, $Na^+$, $K^+$, and ammonium.

$R_{16}$ is preferably a cyano group, a carboxyl group, a carbamoyl group having a C number of 1 to 10, an alkoxycarbonyl group having a C number of 2 to 10, an aryloxycarbonyl group having a C number of 7 to 11, a sulfamoyl group having a C number of 0 to 10, a sulfo group, an alkyl group having a C number of 1 to 10 (e.g., methyl, carboxymethyl, or sulfomethyl), a sulfonyl group having a C number of 1 to 10 (e.g., methylsulfonyl or phenylsulfonyl), a carbonamido group having a C number of 1 to 10 (e.g., acetamido or benzamido), a sulfonamido group having a C number of 1 to 10 (e.g., methanesulfonamido or toluenesulfonamido), an alkyloxy group (e.g., methoxy or ethoxy), or an aryloxy group (e.g., phenoxy), and most preferably a cyano group, a carbamoyl group, an alkoxycarbonyl group, or a carboxyl group.

$R_{17}$ is preferably a hydrogen atom, an alkyl group having a C number of 1 to 12 (e.g., methyl, sulfomethyl, carboxymethyl, ethyl, 2-sulfoethyl, 2-carboxyethyl, 3-sulfopropyl, 3-carboxypropyl, 5-sulfopentyl, 5-carboxypentyl, or 4-sulfobenzyl), or an aryl group having a C number of 6 to 15 (e.g., phenyl, 4-carboxyphenyl, 3-carboxyphenyl, 2,4-dicarboxyphenyl, 4-sulfophenyl, 3-sulfophenyl, 2,5-disulfophenyl, or 2,4-disulfophenyl), and more preferably an alkyl group having a C number of 1 to 7 or an aryl group having a C number of 6 to 10.

Practical examples of the yellow-colored cyan coupler of the present invention are listed below, but the present invention is not limited to these examples:

(YC-1)

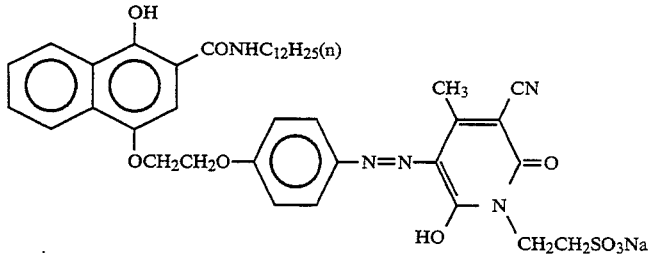

(YC-2)

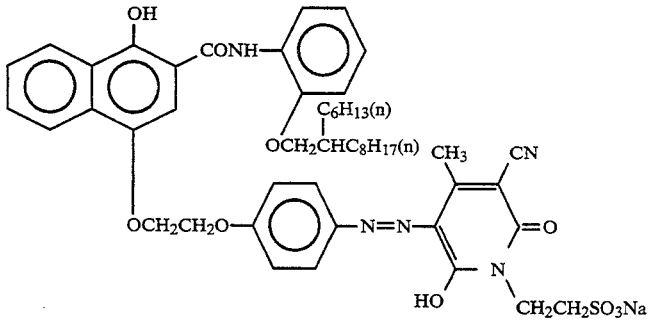

(YC-3)

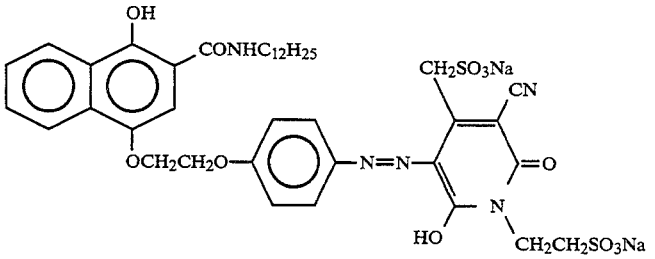

(YC-4)

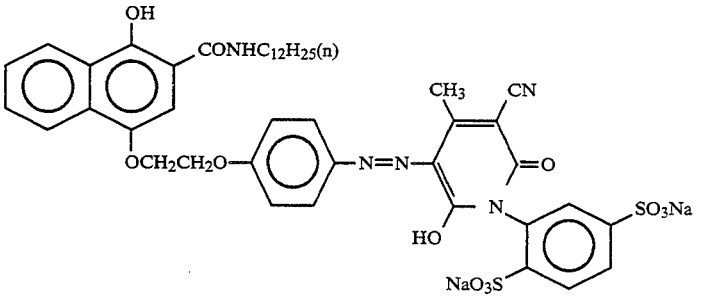

(YC-5)

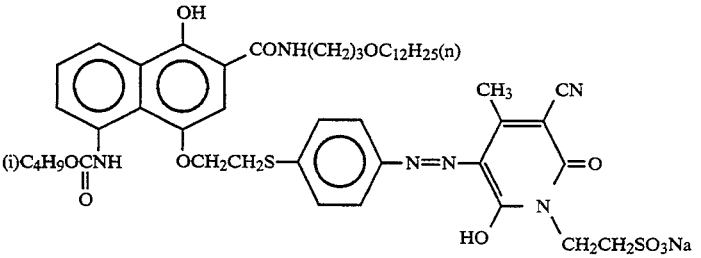

-continued
(YC-6)
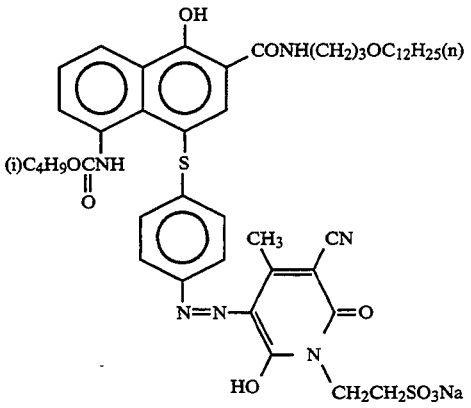
(YC-7)
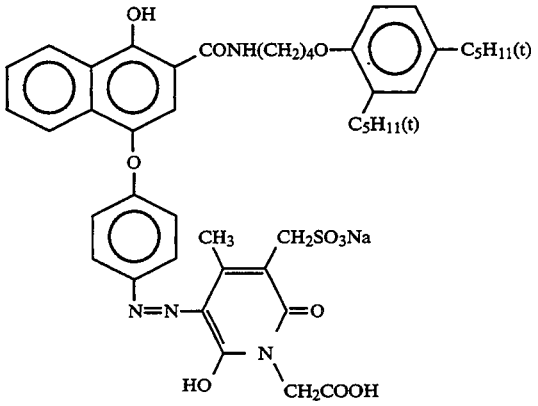
(YC-8)
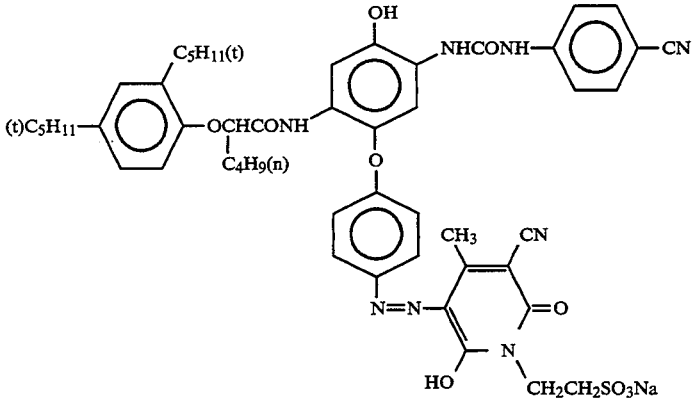
(YC-9)
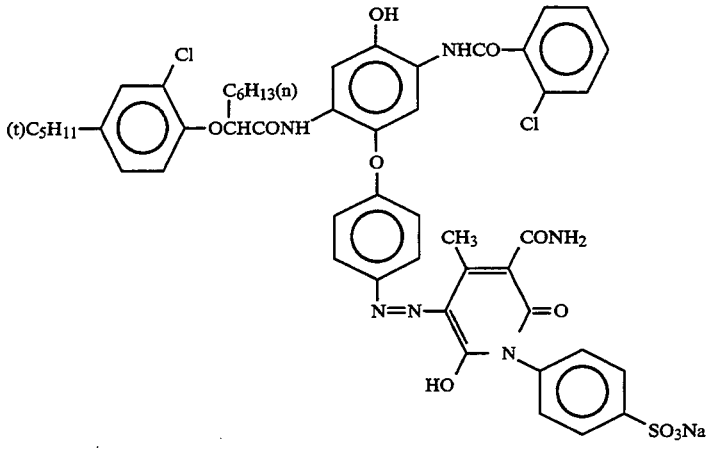

-continued
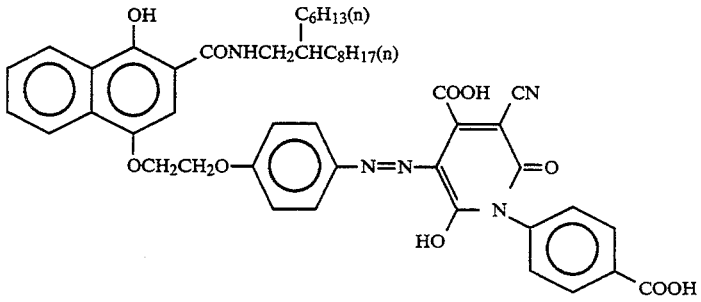
(YC-10)
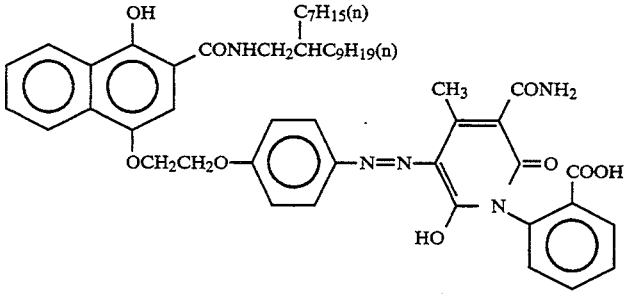
(YC-11)
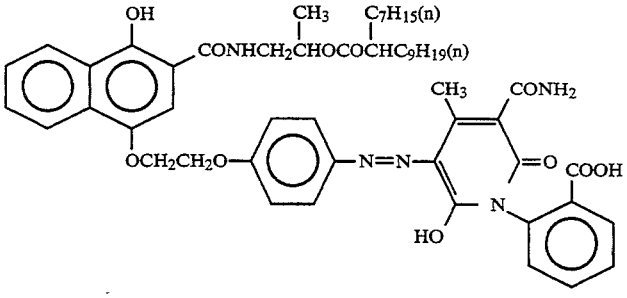
(YC-12)
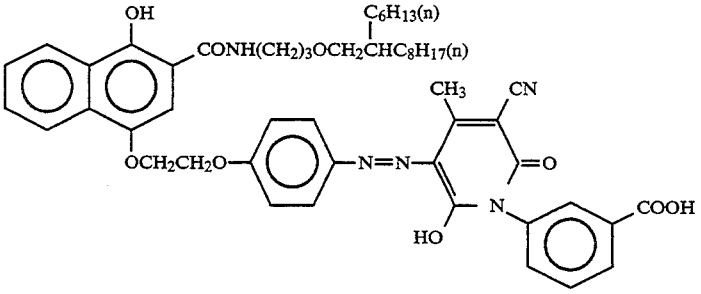
(YC-13)
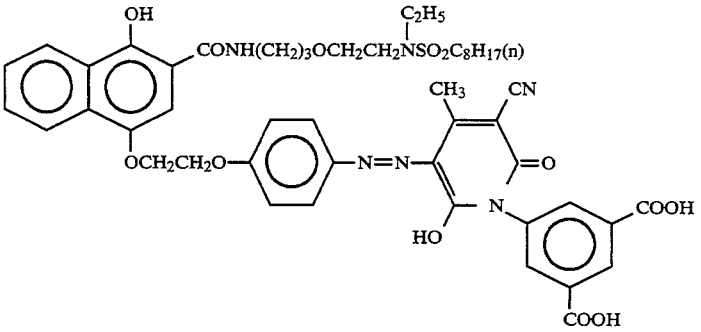
(YC-14)

-continued
(YC-15)
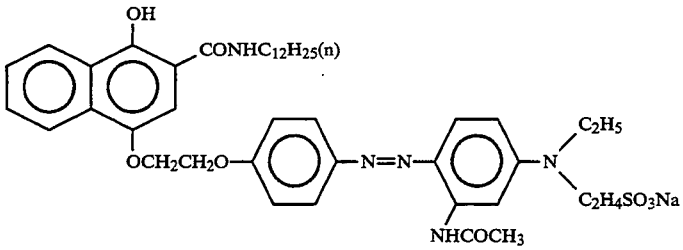
(YC-16)
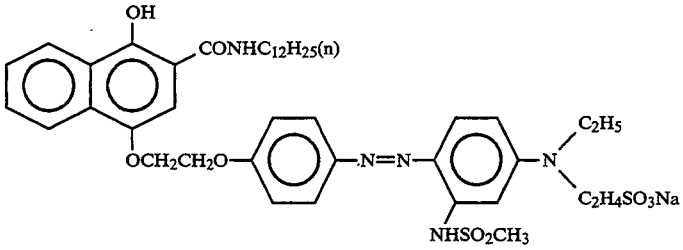
(YC-17)
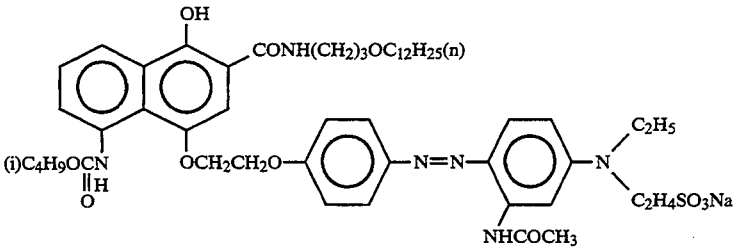
(YC-18)
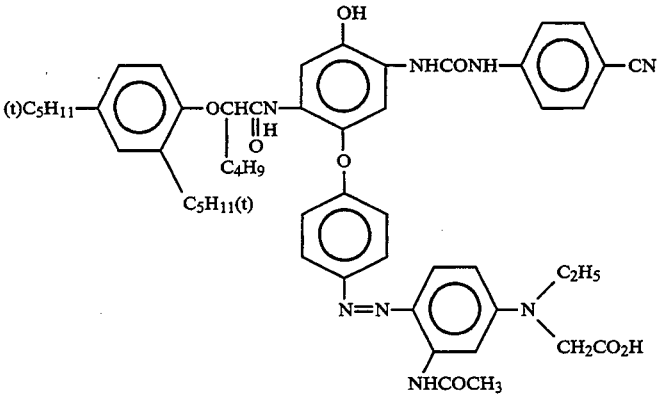
(YC-19)
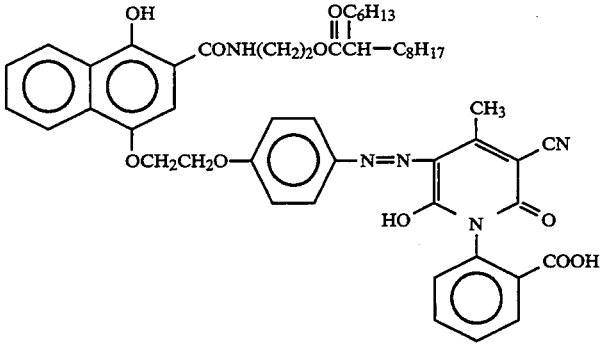

-continued
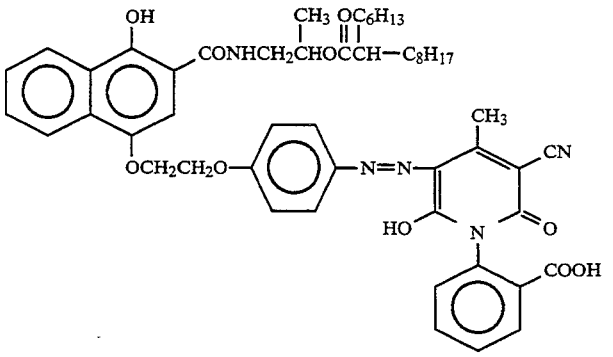
(YC-20)
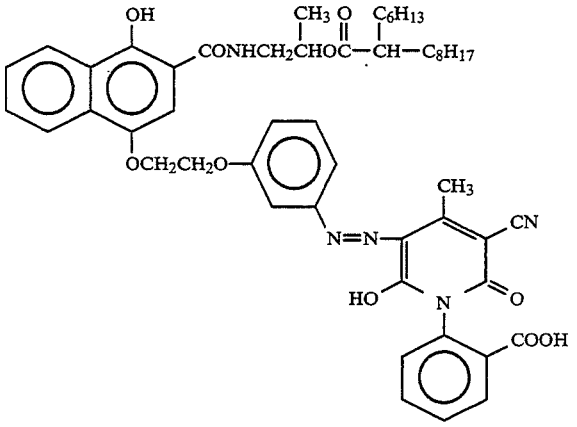
(YC-21)
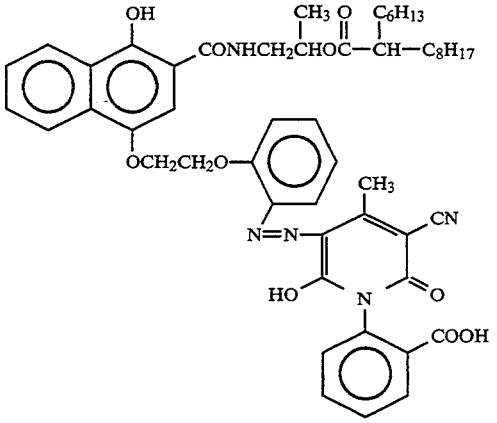
(YC-22)
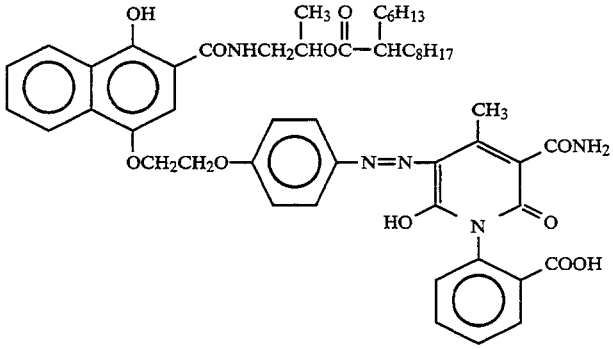
(YC-23)

-continued
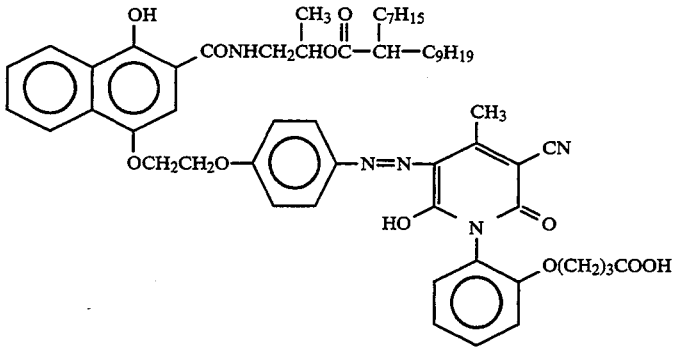
(YC-24)
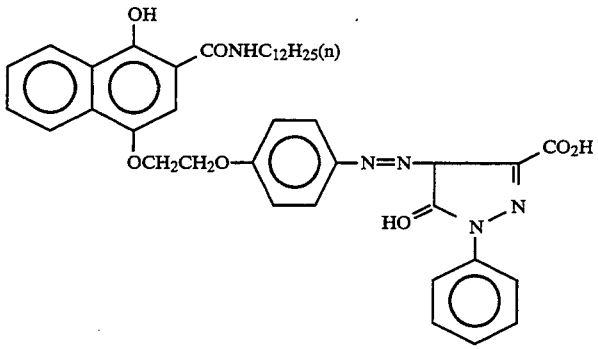
(YC-25)
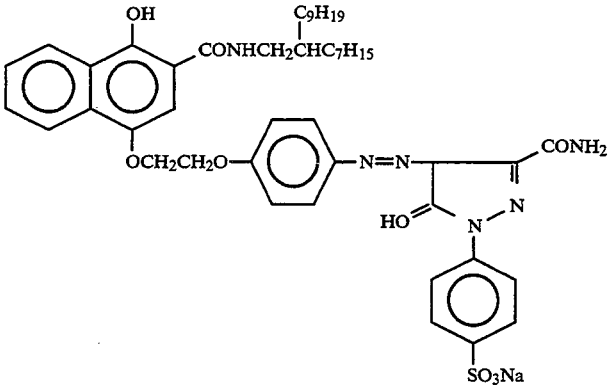
(YC-26)
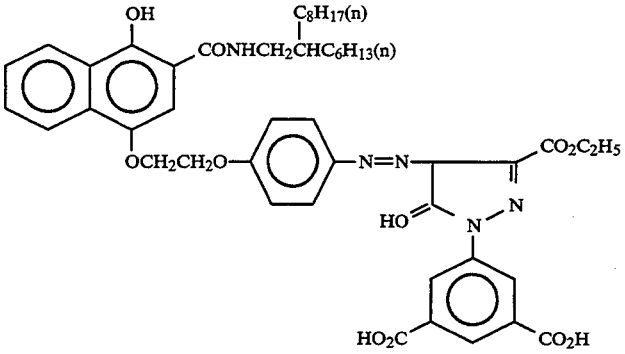
(YC-27)

-continued (YC-28)

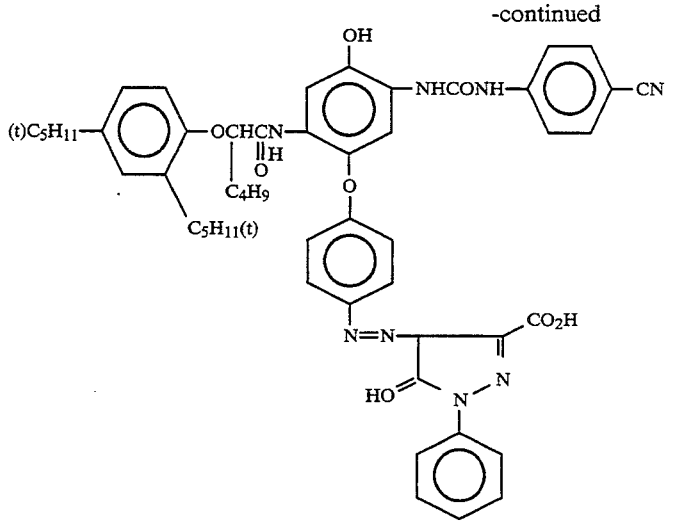

(YC-29)

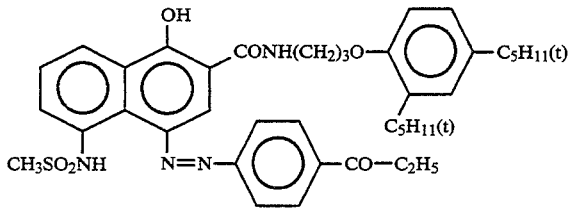

In the present invention, yellow-colored cyan couplers represented by formulas (CI) and (CII) are mere preferably used, with those represented by formula (CI) being most preferred.

The total amount of the yellow-colored cyan coupler added to the light-sensitive material of the present invention is 0.005 to 0.30 g/m$^2$, preferably 0.02 to 0.20 g/m$^2$, more preferably 0.03 to 0.15 g/m$^2$.

Preferably, a red-sensitive emulsion layer having a lower sensitivity contains at least one compound (DIR compound) which releases a development inhibitor or a precursor thereof, upon reacting with an oxidized form of a developing agent used in the invention, or which cleaves to form another compound after reacting with an oxidized form of a developing agent, which cleaved compound in turn reacts with another molecule of the oxidized form of a developing agent to release a development inhibitor. These compounds can be preferably represented by the following formula (XI) or (XII).

A-(TIME)$_a$-DI Formula (XI)

A-(TIME)$_i$-RED-DI Formula (XII)

where A represents a group which splits off (TIME)$_a$-DI or (TIME)$_i$-RED-DI upon reaction (e.g., coupling reaction, or redox reaction) with an oxidized form of an aromatic primary amine color developing agent; TIME represents a timing group which cleaves DI or RED-DI after released from A; RED represents a group which cleaves DI by reacting with an oxidized form of a developing agent after released from A or TIME; DI represents a development inhibitor; a is 0, 1, or 2, and i is 0 or 1, and when a is two, two TIMEs may be the same or different.

When A represents a yellow dye-forming coupler moiety, examples of the coupler moiety are pivaloylacetoanilide-type, benzoylacetoanilide-type, malonester-type, malonamide-type, malonestermonoamide-type, benzoimidazolylacetoamide-type, and cycloalkanoylacetoamide-type coupler moieties. Further, the coupler moiety may be of the type disclosed in U.S. Pat. Nos. 5,021,332, or 5,021,330, or British Patent 421221A.

When A represents a magenta dye-forming coupler moiety, examples of the coupler moiety are 5-pyrazolone-type, pyrazolobenzimidazole-type, pyrazolotriazole-type, pyrazoloimidazole-type, and cyanoacetophenone-type coupler moieties.

When A represents a cyan color dye-forming coupler moiety, examples thereof are phenol-type and naphthol-type coupler moieties. Further, the coupler moiety may be of the type disclosed in U.S. Pat. No. 4,746,602, or European Patent 249453A.

Further, a coupler moiety represented by A may a coupler moiety which does not substantially form a dye. Examples of the non-dye-forming coupler moiety are indanone-type and acetophenone-type coupler moieties, and the dissolving-out type coupler moiety disclosed in European Patent 443530A or 444501A.

When A represents a redox group, the group is one which can be oxidized by an oxidizing substance present during development, for example, an oxidized form of a developing agent. Examples of the group are of hydroquinone-type, catechol-type, pyrogallol-type, 1,4 (or 1,2)-naphthohydroquinone-type, sulfonamidophenol-type, hydrazide-type and sulfonamidonaphthol-type. Specific examples of these groups are disclosed in JP-A-61-230135, JP-A-62-251746, JP-A-61-278852, U.S. Pat. Nos. 3,364,022, 3,379,529, 4,618,571, 3,639,417 and 4,684,604, and J. Org. Chem., vol.29, page 588 (1964).

In formula (XI) or (XII), preferable examples of A are coupler moieties represented by the following formulas (Cp-1), (Cp-2), (Cp-3), (Cp-4), (Cp-5), (Cp-6), (Cp-7), (Cp-8), (Cp-9), and (Cp-10). These types of couplers are preferable because of their high coupling rates.

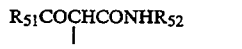

Farmula (Cp-1)

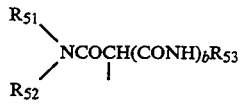

Farmula (Cp-2)

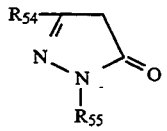

Farmula (Cp-3)

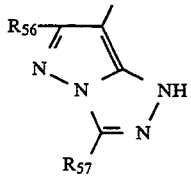

Farmula (Cp-4)

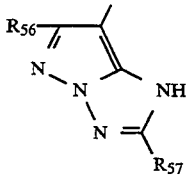

Farmula (Cp-5)

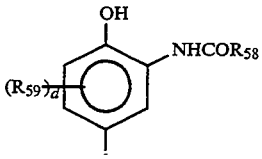

Farmula (Cp-6)

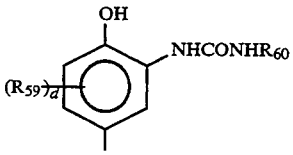

Farmula (Cp-7)

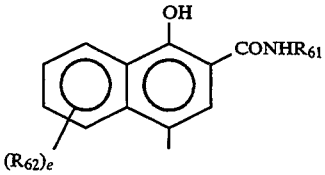

Farmula (Cp-8)

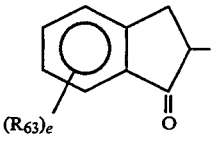

Farmula (Cp-9)

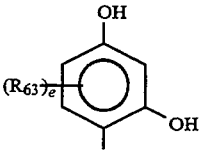

Farmula (Cp-10)

A free bond derived from the coupling position in the above formulas is a bonding position of a coupling split-off group.

In the above formulas, when $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$, or $R_{63}$ contains a non-diffusing group, they have 8 to 40 carbon atoms, preferably 10 to 30 carbon atoms, otherwise the total number of carbon atom is preferably 15 or less. In the case of the bis-type, telomer-type, or polymer-type coupler, any of the above substituent is a divalent group, which links the repeating units or the like. In this case, the number of carbon atoms may be out of the set range.

The substituent groups $R_{51}$–$R_{63}$, and b, d and e will be described in detail. In the following description, $R_{41}$ represents an alkyl group, an aryl group or a heterocyclic group, $R_{42}$ represents an aryl group or a heterocyclic group, each of $R_{43}$, R44, and R45 represents a hydrogen atom, an alkyl group, an aryl group or a heterocyclic group. $R_{51}$ has the same meaning as $R_{41}$. Each of $R_{52}$ and $R_{53}$ has the same meaning as $R_{43}$. b is 0 or 1. $R_{54}$ represents a group of the same meaning as $R_{41}$, $R_{41}CO(R_{43})N$— group, $R_{41}SO_2(R_{43})N$— group, $(R_{43})N$— group, $R_{41}(R_{43})N$— group, $R_{41}S$— group, or $R_{45}(R_{43})NCON(R_{44})N$— group.

$R_{55}$ is a group of the same meaning as $R_{41}$. Each of $R_{56}$ and $R_{57}$ represents a group of the same meaning as $R_{43}$, or $R_{41}S$— group, $R_{43}O$— group, $R_{41}CO(R_{43})N$— group, or $R_{41}SO_2(R_{43})N$— group. $R_{58}$ is a group of the same meaning as $R_{41}$. $R_{59}$ is a group of the same meaning as $R_{41}$, $R_{41}CO(R_{43})N$— group, $R_{41}OCO(R_{43})N$— group, $R_{41}SO_2(R_{43})N$— group, $R_{43}(R_{44})NCO(R_{45})N$— group, $R_{41}O$— group, $R_{41}S$— group, a halogen atom, or $R_{41}(R_{43})N$— group. d is an integer of 0–3. When d is two or more, a plurality of $R_{59}$ groups may be the same or different. $R_{60}$ is a group of the same meaning as $R_{41}$. $R_{61}$ is a group of the same meaning as $R_{41}$. $R_{62}$ is a group of the same meaning as $R_{41}$, or $R_{41}CONH$— group, $R_{41}OCONH$— group, $R_{41}SO_2NH$— group, $R_{43}(R_{44})NCONH$— group, $R_{43}(R_{44})NSO_2NH$— group, $R_{43}O$— group, $R_{41}S$— group, a halogen atom, or $R_{41}NH$— group. $R_{63}$ is a group of the same meaning as $R_{41}$, or $R_{43}CO(R_{44})N$— group, $R_{43}(R_{44})NCO$— group, $R_{41}SO_2(R_{43})N$— group, $R_{41}(R_{43})NSO_2$— group, $R_{41}SO_2$— group, $R_{43}OCO$— group, a halogen atom, a nitro group, a cyano group, or $R_{43}CO$— group. e is an integer of 0 to 4. When there are a plural number of $R_{62}$ or $R_{63}$, they may be the same or different.

In the above description, an alkyl group is a saturated or unsaturated, chain or cyclic, straight or branched, or substituted or unsubstituted alkyl group having 1 to 32, preferably 1 to 22, carbon atoms. Typical examples are methyl, cyclopropyl, isopropyl, n-butyl, t-butyl, i-butyl, t-amyl, cyclohexyl, 2-ethylhexyl, 1,1,3,3-tetramethylbutyl, n-dodecyl, n-hexadecyl, and n-octadecyl.

An aryl group has 6 to 20 carbon atoms, and is preferably a substituted or unsubstituted phenyl, or a substituted or unsubstituted naphthyl.

A heterocyclic group is a substituted or unsubstituted, preferably 3- to 8-membered, hetrocyclic group having 1 to 20, preferably 1 to 7 carbon atoms, and containing a heteroatom selected from nitrogen, oxygen and sulfur atoms. Typical examples of the heterocyclic group are 2-imidazolyl, 2-benzimidazolyl, morpholino, pyrrolidino, 1,2,4-triazol-2-yl, or 1-indolynyl.

When the above-listed alkyl group, aryl group, or heterocyclic group has a substituent, typical examples of the substituent are a halogen atom, $R_{47}O$— group, $R_{46}S$— group, $R_{47}CO(R_{48})N$— group, $R_{47}(R_{48})NCO$— group, $R_{46}SO_2(R_{47})N$— group, $R_{47}(R_{48})NSO_2$— group, $R_{46}SO_2$— group, $R_{47}OCO$— group, $R_{47}CONHSO_2$— group, $R_{47}(R_{48})NCONHSO_2$— group, a group of the same meaning as $R_{46}$, $R_{47}(R_{48})N$— group, $R_{46}CO$— group, a cyano group and a nitro group. $R_{46}$ represents an alkyl group, an aryl group, or a heterocyclic group, and each of $R_{47}$ and $R_{48}$ represents an alkyl group, an aryl group, a heterocyclic group, or a hydrogen atom. Each of the alkyl group, aryl group, and heterocyclic group has the same meaning defined before.

The development inhibitor represented by DI will now be described.

Examples of the development inhibitor represented by DI are those disclosed in U.S. Pat. Nos. 4,477,563, 5,021,332, 5,026,628, 3,384,657, 3,615,506, 3,617,291, 3,733,201, 3,933,500, 3,958,993, 3,961,959, 4,149,886, 4,259,437, 4,095,984 and 4,782,012, British Patent 1,450,479, and U.S. Pat. No. 5,034,311. Preferable examples are tetrazolylthio, 1,3,4-oxadiazolylthio, 1,3,4-thiazoazolylthio, 1-(or 2-)benzotriazolyl, 1,2,4-triazol-1-(or 4-)yl, 1,2,3-triazol-1-yl, 2-benzothiazolylthio, 2-benzimidazolylthio, and derivatives thereof. Typical development inhibitors are as follows. In the following formulas, "}" means that the substituent bonds to the 5- or 6-position of the benzotriazole.

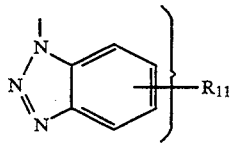

| $R_{11}$ | $-CO_2CH_2CO_2C_5H_{11}(i)$ | $-CO_2CH_2CO_2C_4H_9$ | $-CO_2C_6H_5$ |
|---|---|---|---|
| D-No. | (D-1) | (D-2) | (D-3) |

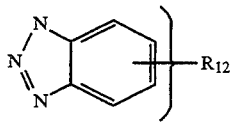

| $R_{12}$ | $-CO_2CH_2CO_2C_5H_{11}(i)$ | $-CO_2CH_2CO_2C_4H_9$ | $-CO_2C_6H_5$ |
|---|---|---|---|
| D-No. | (D-4) | (D-5) | (D-6) |

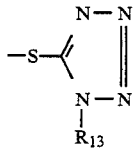

| $R_{13}$ | $-C_2H_5$ | $-C_4H_9$ | $-C_4H_9(t)$ | $-C_6H_5$ |
|---|---|---|---|---|
| D-No. | (D-7) | (D-8) | (D-9) | (D-10) |

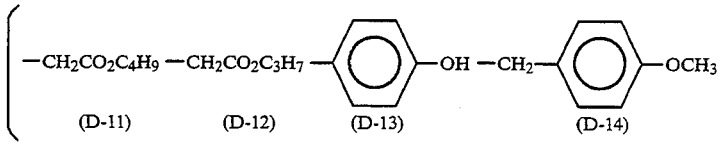

(D-11) (D-12) (D-13) (D-14)

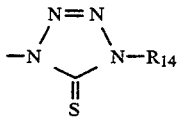

| $R_{14}$ | $-C_4H_9$ | $-CH_2CO_2C_4H_9$ | $-C_6H_5$ |
|---|---|---|---|
| D-No. | (D-15) | (D-16) | (D-17) |

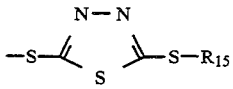

| $R_{15}$ | $-CH_3$ | $-CH_2CO_2C_2H_5$ | $-CH(CH_3)CO_2CH_3$ |
|---|---|---|---|
| D-No. | (D-18) | (D-19) | (D-20) |

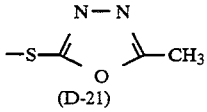

(D-21)

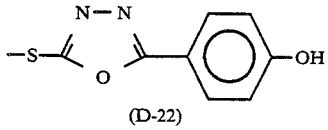

(D-22)

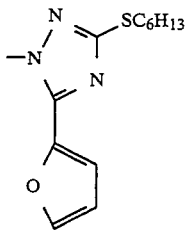

(D-23)

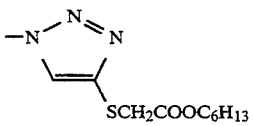

(D-24)

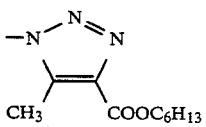

(D-25)

The group represented by TIME will now be described.

The group represented by TIME can be any linking group which can cleave DI or RED-DI after being cleaved from A during a development process. Examples thereof are groups utilizing the cleaving reaction of hemiacetal, disclosed in U.S. Pat. Nos. 4,146,396, 4,652,516, and 4,698,297; timing groups causing a cleaving reaction by utilizing an intramolecular nucleophilic substitution reaction, disclosed in U.S. Pat. Nos. 4,248,962, 4,847,185, and 4,857,440; timing groups causing a cleaving reaction by utilizing an electron transfer reaction, disclosed in U.S. Pat. Nos. 4,409,323, and 4,421,845; groups causing a cleaving reaction by utilizing a hydrolysis reaction of iminoketal, disclosed in U.S. Pat. No. 4,546,073; and groups causing a cleaving reaction by utilizing a hydrolysis reaction of ester, disclosed in West German Patent 2626317. TIME is bonded to A at a heteroatom, preferably an oxygen atom, a sulfur atom, or a nitrogen atom, contained in TIME. Preferable groups represented by TIME are those expressed by the following formulas (T-11), (T-12), and (T-13).

$$*\text{—W—}(X_5=Y_2)_g\text{—C}(R_{121})R_{122}\text{—}^{**} \qquad \text{Formula (T-11)}$$

$$*\text{—W—CO—}^{**} \qquad \text{Formula (T-12)}$$

$$*\text{—W—LINK—E—}^{**} \qquad \text{Formula (T-13)}$$

where * represents the position at which the group is bonded to A in formula (XI) or (XII), ** represents the position at which the group is bonded to DI or TIME (when a is plural), W represents an oxygen atom, a sulfur atom, or $>$N—$R_{123}$, each of $X_5$ and $Y_2$ represents a methyne or nitrogen atom, g is 0, 1, or 2, and each of $R_{121}$, $R_{122}$, and $R_{123}$ represents a hydrogen atom or a substituent. When each of $X_5$ and $Y_2$ represent a substituted methyne group, any two of substituents $R_{121}$, $R_{122}$, and $R_{123}$ may or may not combine together to form a cyclic structure (for example, a benzene ring, and a pyrazole ring). In the formula (T-13), E represents an electrophilic group, and LINK represents a linking group which sterically connects W and E such that they may undergo an intramolecular nucleophilic substitution reaction.

Typical examples of TIME are as follows:

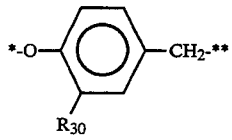

| $R_{30}$ | —$NO_2$ | —$NHSO_2CH_3$ | H | —$NHSO_2C_{16}H_{33}$ |
|---|---|---|---|---|
| TI-No. | (TI-1) | (TI-2) | (TI-3) | (TI-4) |

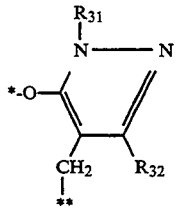

| $R_{31}$ | —$NO_2$ | —$NO_2$ | |
|---|---|---|---|
| $R_{32}$ | —$CH_3$ | —$C_{11}H_{23}$ | —$CH_3$ |
| TI-No. | (TI-5) | (TI-6) | (TI-7) |

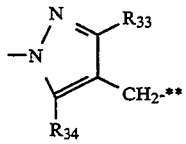

| $R_{33}$ | —$CH_3$ | —$CH_3$ | —$C_2H_5$ |
|---|---|---|---|
| $R_{34}$ | —$CH_3$ | —H | —H |
| TI-No. | (TI-8) | (TI-9) | (TI-10) |

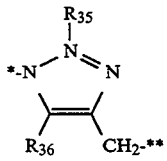

| $R_{35}$ | —$CH_3$ | —H | —H |
|---|---|---|---|
| $R_{36}$ | —H | —H | —$CH_3$ |
| TI-No. | (TI-11) | (TI-12) | (TI-13) |

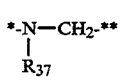

| $R_{37}$ | —$CH(CH_3)_2$ | —$CH_2CO_2CH_3$ | —$C_{16}H_{31}$ | —$CH_2CO_2C_2H_5$ |
|---|---|---|---|---|
| TI-No. | (TI-14) | (TI-15) | (TI-16) | (TI-17) |

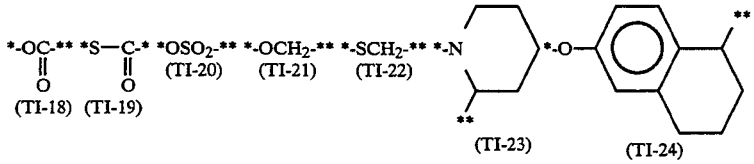

(TI-18) (TI-19) (TI-20) (TI-21) (TI-22) (TI-23) (TI-24)

-continued

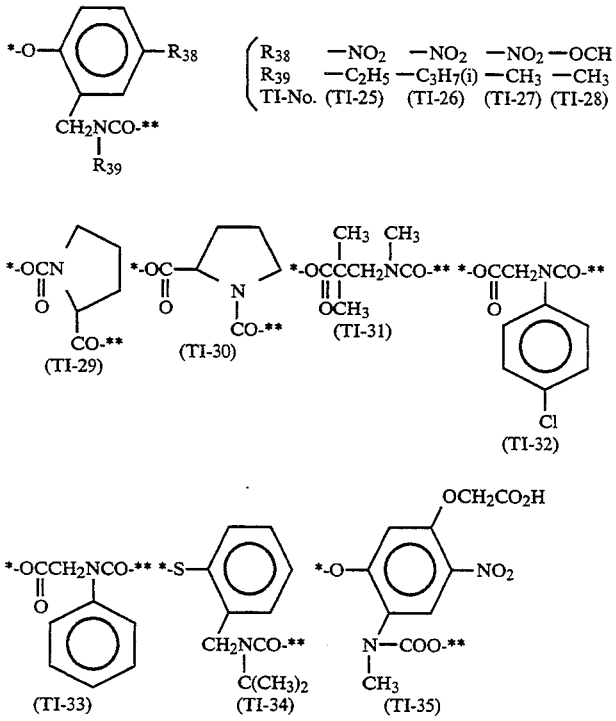

The group represented by RED in formula (XII) will be described.

RED-DI may be any group which cleaves DI when oxidized by a oxidizing material present during a developing process, for example, an oxidized form of a developing agent. Examples of RED are hydroquinones, catechols, pyrogallols, 1,4-naphthohydroquinones, 1,2-naphthohydroquinones, sufonamidophenols, hydrazides, and sulfonamidonaphthol group. Specific examples are the same as those listed in the prior art documents above for the case where A represents a redox group.

Preferable examples of RED are a hydroquinone, a 2(or 4)-sulfonamidophenol, and a pyrogallol. Each of these groups is bonded to A at the oxygen atom of the phenolic hydroxy group.

Typical examples of the DIR compound used in the present invention will be listed, but the invention is not limited to these examples.

| Cp-No. | a | TIME | DI | BALL |
|---|---|---|---|---|
| | | | 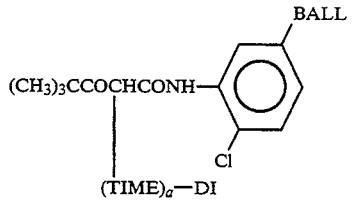 | |
| (1) | 0 | not present | (D-3) | 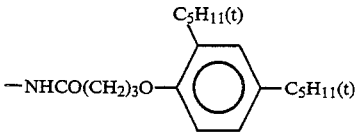 |
| (2) | 0 | not present | (D-1) | " |
| (3) | 1 | (TI-25) | (D-12) | $-NHSO_2C_{16}H_{33}$ |
| (4) | 1 | (TI-25) | (D-14) | " |
| (5) | 1 | (TI-25) | (D-11) | " |
| (6) | 2 | (TI-35) | (TI-3), (D-19) | $-NHSO_2C_{16}H_{33}$ |
| (7) | 1 | (TI-7) | (D-19) | $-NHSO_2C_{12}H_{25}$ |

-continued
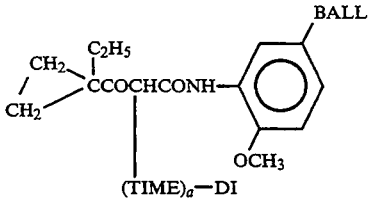
| | | | | |
|---|---|---|---|---|
| (8) | 0 | not present | (D-1) | $-NHSO_2C_{16}H_{33}$ |
| (9) | 1 | (TI-8) | (D-12) | $-COOC_{12}H_{25}$ |
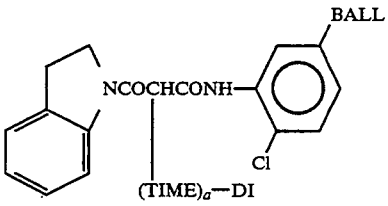
| | | | | |
|---|---|---|---|---|
| (10) | 0 | not present | (D-1) | $-SO_2NHCOC_{13}H_{27}$ |
| (11) | 0 | not present | (D-1) | $-SO_2NHCONHC_{16}H_{33}$ |
| (12) | 0 | not present | (D-1) | 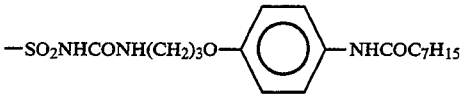 |
| (13) | 0 | not present | (D-3) | 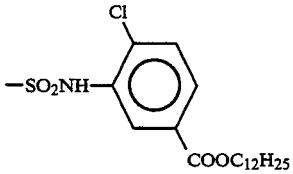 |
| (14) | 1 | (TI-1) | (D-12) | $-CONHSO_2C_{16}H_{33}$ |
| (15) | 0 | not present | (D-1) | 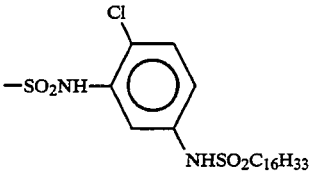 |
| (16) | 1 | (TI-25) | (D-12) | 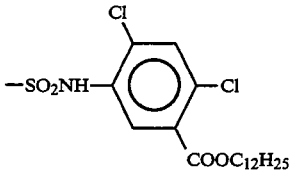 |
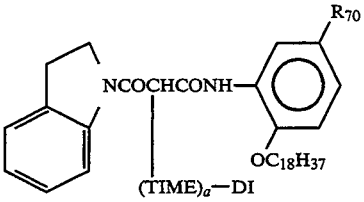
| Cp-No. | a | TIME | DI | $R_{70}$ |
|---|---|---|---|---|
| (17) | 0 | not present | (D-1) | 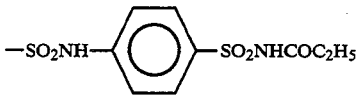 |
| (18) | 1 | (TI-1) | (D-12) | " |

-continued
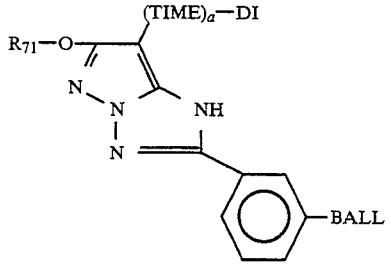
| Cp-No. | a | TIME | DI | $R_{71}$ | BALL |
|---|---|---|---|---|---|
| (19) | 0 | not present | (D-1) | 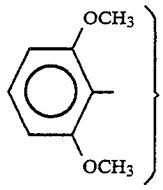 | 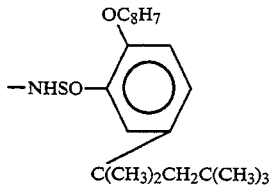 |
| (20) | 0 | not present | (D-2) | | |
| (21) | 0 | not present | (D-4) | | |
| (22) | 1 | (TI-1) | (D-18) | 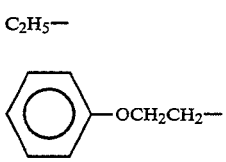 | 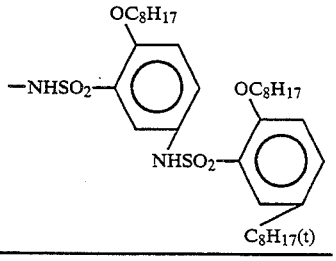 |
| (23) | 1 | not present | (D-25) | | |
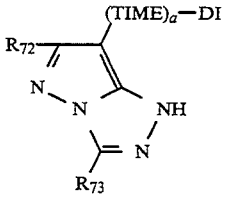
| Cp-No. | a | TIME | DI | $R_{72}$ | $R_{73}$ |
|---|---|---|---|---|---|
| (24) | 0 | not present | (D-1) | $CH_3$— | 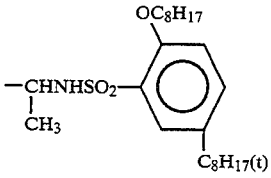 |
| (25) | 0 | not present | (D-2) | $(CH_3)_2CH$— | |
| (26) | 0 | not present | (D-1) | $C_2H_5$— | 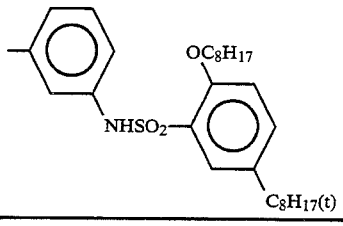 |
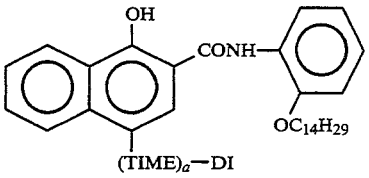
| Cp-No. | a | TIME | DI |
|---|---|---|---|
| (27) | 2 | (TI-18)-(TI-15) | (D-15) |
| (28) | 1 | (TI-21) | (D-3) |

-continued
| | | | |
|---|---|---|---|
| (29) | 1 | (TI-1) | (D-10) |
| (30) | 1 | (TI-1) | (D-14) |
| (31) | 1 | (TI-1) | (D-9) |
| (32) | 2 | (TI-18)–(TI-8) | (D-8) |
| (33) | 2 | (TI-34)–(TI-1) | (D-10) |
| (34) | 2 | (TI-18)–(TI-17) | (D-16) |
| (35) | 2 | (TI-18)–(TI-15) | (D-16) |
| (36) | 2 | (TI-18)–(TI-14) | (D-20) |
| (37) | 1 | (TI-5) | (D-13) |
| (38) | 1 | (TI-5) | (D-21) |
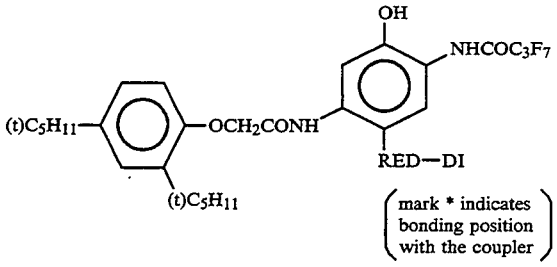
| Cp-No. | RED | DI |
|---|---|---|
| (39) | 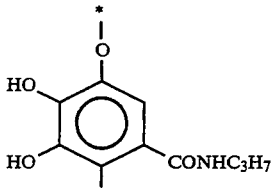 | (D-20) |
| (40) | 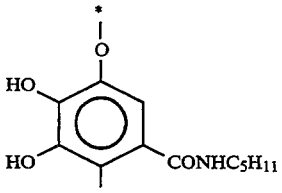 | (D-20) |
| (41) | 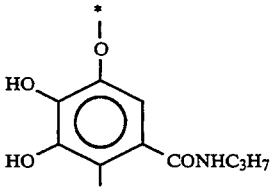 | (D-10) |
| (42) | 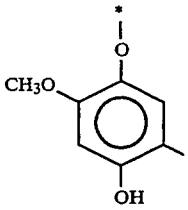 | (D-7) |
| (43) | 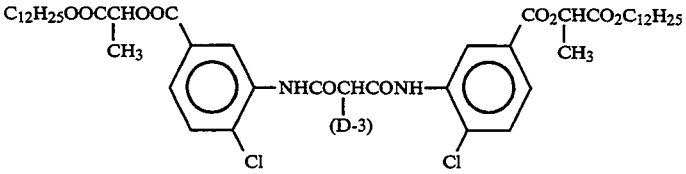 | |

-continued

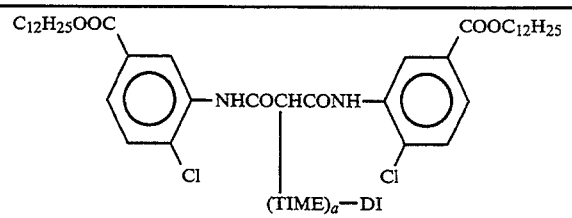

| Cp-No. | a | TIME | DI |
|---|---|---|---|
| (44) | 0 | not present | (D-1) |
| (45) | 0 | not present | (D-3) |
| (46) | 0 | not present | (D-24) |
| (47) | 1 | (TI-12) | (D-9) |

(48)

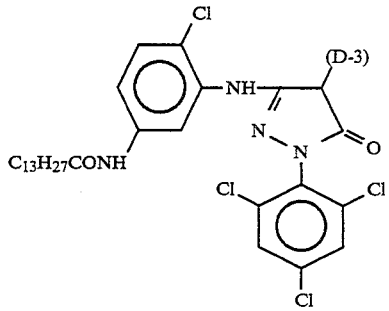

(49)

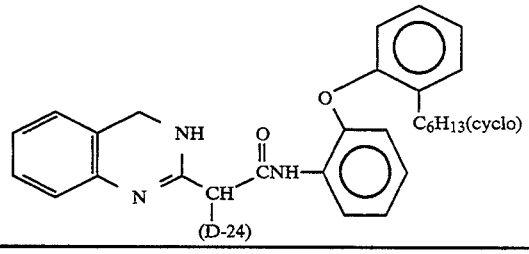

The amount of the DIR compound added to a lower-sensitivity red-sensitive silver halide emulsion layer is preferably 0.005 to 0.200 g/m$^2$, more preferably 0.005 to 0.100 g/m$^2$, most preferably 0.010 to 0.040 g/m$^2$.

The techniques, and the inorganic and organic materials which can be used in the color photographic light-sensitive material of the invention are disclosed in the below-listed sections of European Patent 436,938A2, and the specified patents.

1. Layer structure: page 146, line 34–page 147, line 25
2. Silver halide emulsion: page 147, line 26–page 148, line 12
3. Yellow coupler: page 137, line 35–146, line 33, and page 149, lines 21–23
4. Magenta coupler: page 149, lines 24–28; European Patent No. 421,453A1, page 3, line 5–page 25, line 55
5. Cyan coupler: page 149, lines 29–33, European Patent No. 432,804A2, page 3, line 28–page 40, line 2
6. Polymer coupler: page 149, lines 34–38; European Patent No. 435,334A2, page 113, line 39–page 23, line 7
7. Colored coupler: page 53, line 42–page 137, line 34, and page 149, lines 39–45
8. Other functional couplers: page 7, line 1–page 53, line 41, and page 149, line 46–page 150, line 30; European Patent No. 435,334A2, page 3, line 1–page 29, line 50
9. Antiseptics and mildewcides: page 150, lines 25–28
10. Formalin scavenger: page 149, lines 15–17
11. Other additives: page 153, lines 38–47; European Patent No. 421,453A1, page 75, line 21–page 84, line 56, page 27, line 40–page 37, line 40
12. Dispersion method: page 150, lines 4–24
13. Support: page 150, lines 32–34
14. Film thickness and film properties: page 150, lines 35–49
15. Color developing process: page 150, line 50–page 151, line 47
16. Desilvering step: page 151, line 48–page 152, line 53
17. Automatic developing machine: page 152, line 54–page 153, line 2
18. Water washing and stabilization step: page 153, lines 3–37

EXAMPLE 1

Multiple layers having the following compositions were coated on a subbed triacetylcellulose film support, thereby obtaining a multilayered color light-sensitive material as a sample 101.

Compositions of Layers

The coated amounts of silver halide and colloidal silver are expressed by the amount of silver in unit of g/m$^2$, the amounts of couplers, additives and gelatins are expressed in unit of g/m$^2$, and the amounts of sensitizing dyes are expressed in mole per mole of silver halide in the same layer. The reference symbols indicate the following substances. When a substance exhibits a plurality of effects, the most typical one is cited.

UV: ultraviolet ray absorber, Solv: High-boiling point organic solvent, ExF: dye, ExS: sensitizing dye, ExC: cyan coupler, ExM: magenta coupler, ExY: yellow coupler, Cpd: additive

| | |
|---|---|
| Layer 1: Antihalation layer | |
| Black colloidal silver | 0.15 |
| Gelatin | 2.33 |
| UV-1 | $3.0 \times 10^{-2}$ |
| UV-2 | $6.0 \times 10^{-2}$ |
| UV-3 | $7.0 \times 10^{-2}$ |
| Cpd-5 | $1.0 \times 10^{-3}$ |
| Solv-1 | 0.16 |
| Solv-2 | 0.10 |
| Layer 2 (Low-speed red-sensitive layer) | |
| Silver iodobromide emulsion A | 0.40 |
| Amount of silver coated | |
| Silver iodobromide emulsion B | 0.20 |
| Amount of silver coated | |
| Gelatin | 0.77 |
| ExS-1 | $2.4 \times 10^{-4}$ |
| ExS-2 | $1.4 \times 10^{-4}$ |
| ExS-5 | $2.3 \times 10^{-4}$ |
| ExS-7 | $4.1 \times 10^{-6}$ |
| ExC-1 | $9.9 \times 10^{-2}$ |
| ExC-2 | $5.0 \times 10^{-3}$ |
| ExC-5 | $9.5 \times 10^{-2}$ |
| ExC-9 | $2.5 \times 10^{-2}$ |
| Cpd-4 | $2.2 \times 10^{-2}$ |
| Layer 3: (Medium-speed red-sensitive emulsion layer) | |
| Silver iodobromide emulsion C | 0.53 |
| Amount of silver coated | |
| Gelatin | 1.46 |
| ExS-1 | $2.4 \times 10^{-4}$ |
| ExS-2 | $1.4 \times 10^{-4}$ |
| ExS-5 | $2.4 \times 10^{-4}$ |
| ExS-7 | $4.3 \times 10^{-6}$ |
| ExC-1 | 0.19 |
| ExC-2 | $1.0 \times 10^{-2}$ |
| ExC-3 | $4.0 \times 10^{-2}$ |
| ExC-4 | $1.6 \times 10^{-2}$ |
| ExC-5 | 0.19 |
| ExC-9 | $3.0 \times 10^{-2}$ |
| Cpd-4 | $1.5 \times 10^{-3}$ |
| Layer 4: (High-speed red-sensitive emulsion layer) | |
| Silver iodobromide emulsion D | 1.20 |
| Amount of silver coated | |
| Gelatin | 1.38 |
| ExS-1 | $2.0 \times 10^{-4}$ |
| ExS-2 | $1.1 \times 10^{-4}$ |
| ExS-5 | $1.9 \times 10^{-4}$ |
| ExS-7 | $1.4 \times 10^{-5}$ |
| ExC-1 | $9.0 \times 10^{-2}$ |
| ExC-3 | $1.0 \times 10^{-2}$ |
| ExC-4 | $1.6 \times 10^{-2}$ |
| ExC-5 | $7.0 \times 10^{-2}$ |
| ExC-7 | $2.5 \times 10^{-2}$ |
| ExC-8 | $1.0 \times 10^{-2}$ |
| ExC-9 | $3.0 \times 10^{-2}$ |
| Cpd-4 | $1.0 \times 10^{-3}$ |
| Solv-1 | 0.70 |
| Solv-2 | 0.15 |
| Layer 5: (Interlayer) | |
| Gelatin | 0.62 |
| Cpd-1 | 0.13 |
| Polyethylacrylate latex | $8.0 \times 10^{-2}$ |
| Solv-1 | $8.0 \times 10^{-2}$ |
| Layer 6: (Low-speed green-sensitive emulsion layer) | |
| Silver iodobromide emulsion E | 0.15 |
| Amount of silver coated | |
| Silver iodobromide emulsion F | 0.28 |
| Amount of silver coated | |
| Gelatin | 0.31 |
| ExS-3 | $1.0 \times 10^{-4}$ |
| ExS-4 | $3.1 \times 10^{-4}$ |
| ExS-5 | $6.4 \times 10^{-5}$ |

-continued

| | |
|---|---|
| ExM-1 | 0.12 |
| ExM-7 | $2.1 \times 10^{-2}$ |
| Solv-1 | 0.09 |
| Solv-3 | $7.0 \times 10^{-3}$ |
| Layer 7: (Medium-speed green-sensitive emulsion layer) | |
| Silver iodobromide emulsion G | 0.35 |
| Amount of silver coated | |
| Gelatin | 0.54 |
| ExS-3 | $2.7 \times 10^{-4}$ |
| ExS-4 | $8.2 \times 10^{-4}$ |
| ExS-5 | $1.7 \times 10^{-4}$ |
| ExM-1 | 0.27 |
| ExM-7 | $7.2 \times 10^{-2}$ |
| ExY-1 | $5.4 \times 10^{-2}$ |
| Solv-1 | 0.23 |
| Solv-3 | $1.8 \times 10^{-2}$ |
| Layer 8: (High-speed green-sensitive emulsion layer) | |
| Silver iodobromide emulsion H | 0.61 |
| Amount of silver coated | |
| Gelatin | 0.61 |
| ExS-4 | $4.3 \times 10^{-4}$ |
| ExS-5 | $8.6 \times 10^{-5}$ |
| ExS-8 | $2.8 \times 10^{-5}$ |
| ExM-2 | $5.5 \times 10^{-3}$ |
| ExM-3 | $1.0 \times 10^{-2}$ |
| ExM-5 | $1.0 \times 10^{-2}$ |
| ExM-6 | $3.0 \times 10^{-2}$ |
| ExY-1 | $1.0 \times 10^{-2}$ |
| ExC-1 | $4.0 \times 10^{-3}$ |
| ExC-4 | $2.5 \times 10^{-2}$ |
| Cpd-6 | $1.0 \times 10^{-2}$ |
| Solv-1 | 0.12 |
| Layer 9: (Interlayer) | |
| Gelatin | 0.56 |
| UV-4 | $4.0 \times 10^{-2}$ |
| UV-5 | $3.0 \times 10^{-2}$ |
| Cpd-1 | $4.0 \times 10^{-2}$ |
| Polyethylacrylate latex | $5.0 \times 10^{-2}$ |
| Solv-1 | $3.0 \times 10^{-2}$ |
| Layer 10: (Donor layer of an interlayer effect to red-sensitive layer) | |
| Silver iodobromide emulsion I | 0.15 |
| Amount of silver coated | |
| Silver iodobromide emulsion J | 0.25 |
| Amount of silver coated | |
| Silver iodobromide emulsion K | 0.60 |
| Amount of silver coated | |
| Gelatin | 0.87 |
| ExS-3 | $6.7 \times 10^{-4}$ |
| ExM-2 | 0.16 |
| ExM-4 | $3.0 \times 10^{-2}$ |
| ExM-5 | $5.0 \times 10^{-2}$ |
| ExY-2 | $2.5 \times 10^{-3}$ |
| ExY-5 | $2.0 \times 10^{-2}$ |
| Solv-1 | 0.30 |
| Solv-5 | $3.0 \times 10^{-2}$ |
| Layer 11: (Yellow Filter Layer) | |
| Yellow colloidal silver | $9.0 \times 10^{-2}$ |
| Gelatin | 1.10 |
| Cpd-1 | $5.0 \times 10^{-2}$ |
| Cpd-2 | $5.0 \times 10^{-2}$ |
| Cpd-5 | $2.0 \times 10^{-3}$ |
| Solv-1 | 0.13 |
| H-1 | 0.25 |
| Layer 12: (Low-speed blue-sensitive emulsion layer) | |
| Silver iodobromide emulsion L | 0.45 |
| Amount of silver coated | |
| Silver iodobromide emulsion M | 0.50 |
| Amount of silver coated | |
| Gelatin | 1.75 |
| ExS-6 | $9.0 \times 10^{-4}$ |
| ExY-1 | $8.5 \times 10^{-2}$ |
| ExY-2 | $5.5 \times 10^{-3}$ |
| ExY-3 | $6.0 \times 10^{-2}$ |
| ExY-5 | 1.00 |
| ExC-1 | $5.0 \times 10^{-3}$ |
| ExC-2 | $8.0 \times 10^{-2}$ |
| Solv-1 | 0.54 |

-continued

| | |
|---|---|
| Layer 13: (High-speed blue-sensitive emulsion layer) | |
| Silver iodobromide emulsion N | 0.51 |
| Amount of silver coated | |
| Gelatin | 1.10 |
| ExS-6 | $2.6 \times 10^{-4}$ |
| ExY-2 | $1.0 \times 10^{-2}$ |
| ExY-3 | $2.0 \times 10^{-2}$ |
| ExY-5 | 0.18 |
| ExC-1 | $1.0 \times 10^{-2}$ |
| Solv-1 | $9.0 \times 10^{-2}$ |
| Layer 14: (First protective layer) | |
| Fine grain silver iodobromide emulsion O | 0.12 |
| Amount of silver coated | |
| Gelatin | 1.02 |
| UV-4 | 0.11 |
| UV-5 | 0.18 |
| Cpd-3 | 0.10 |
| Solv-4 | $2.0 \times 10^{-2}$ |
| Polyethylacrylate latex | $9.0 \times 10^{-2}$ |
| Layer 15: (Second protective layer) | |
| Fine grain silver iodobromide emulsion O | 0.36 |
| Amount of silver coated | |
| Gelatin | 1.04 |
| B-1 (diameter: 2.0 μm) | $8.0 \times 10^{-2}$ |
| B-2 (diameter: 2.0 μm) | $8.0 \times 10^{-2}$ |
| B-3 | $2.0 \times 10^{-2}$ |
| W-5 | $2.0 \times 10^{-2}$ |
| H-1 | 0.18 |

The sample thus prepared further contained 1,2-benzisothiazolin-3-one (average of 200 ppm with respect to gelatin), n-butyl-p-hydroxybenzoate about 1000 ppm with respect to gelatin), and 2-phenoxyethanol (about 10000 ppm with respect to gelatin). Each layer contained W-1 to W-6, B-1 to B-6, F-1 to F-16, an iron salt, a lead salt, a gold salt, a platinum salt, an iridium salt, and a rhodium salt, which serve to enhance storage stability, processability, pressure-resistant property, anti-mildew and bacteria property, antistatic property, and coatability, as the case might be.

The emulsions A to O used are indicated in Table 1 below.

TABLE 1

| | Average AgI content (mole %) | Average equivalent-sphere diameter (μm) | Variation coefficient of grain distribution (%) | Ratio of diameter/thickness | Silver amount ratio [core/intermediate/shell] (AgI content) | Grain structure and shape |
|---|---|---|---|---|---|---|
| Emulsion A | 5.0 | 0.40 | 10 | 1.0 | [4/1/5] (1/38/1) | triple structure cubic grain |
| Emulsion B | 6.5 | 0.49 | 23 | 2.0 | [1/2] (16/1) | double structure plate-like grain |
| Emulsion C | 7.0 | 0.65 | 23 | 2.2 | [3/5/2] (0/14/7) | triple structure plate-like grain |
| Emulsion D | 10.0 | 0.81 | 15 | 5.8 | [12/59/29] (0/12/6) | triple structure tabular grain |
| Emulsion E | 3.5 | 0.35 | 25 | 2.8 | — | uniform structure plate-like grains |
| Emulsion F | 4.0 | 0.50 | 18 | 4.0 | — | uniform structure tabular grains |
| Emulsion G | 3.5 | 0.55 | 15 | 3.5 | [12/59/29] (0/5/2) | triple structure tabular grain |
| Emulsion H | 10.0 | 0.70 | 20 | 5.5 | [12/59/29] (0/13/8) | triple structure tabular grain |
| Emulsion I | 3.8 | 0.70 | 15 | 3.5 | [12/59/29] (0/5/3) | triple structure tabular grain |
| Emulsion J | 8.0 | 0.65 | 28 | 2.5 | [1/2] (18/3) | double structure plate-like grain |
| Emulsion K | 10.3 | 0.40 | 15 | 1.0 | [1/3] (29/4) | double structure octahedral grain |
| Emulsion L | 9.0 | 0.52 | 19 | 5.8 | [8/59/33] (0/11/8) | triple structure tabular grain |
| Emulsion M | 2.5 | 0.36 | 30 | 7.0 | — | uniform structure tabular grains |
| Emulsion N | 10.3 | 0.90 | 25 | 3.0 | [7/13] (34/3) | double structure plate-like grain |
| Emulsion O | 2.0 | 0.07 | 15 | 1.0 | — | uniform structure fine grain |

In Table 1, (1) Emulsions A-N had been subjected to reduction-sensitization during preparation of grains, using thiourea dioxide and thiosulfonic acid, in accordance with the Examples disclosed in JP-A-2-191938.

(2) Emulsions A-N had been subjected to gold-sensitization, sulfur-sensitization, and selenium-sensitization in the presence of the spectral sensitizing dyes indicated for each light-sensitive layer and sodium thiocyanate, in accordance with the Examples disclosed in JP-A-3-237450.

(3) For preparation of tabular grains, low molecular weight gelatin had been used in accordance with the Examples set forth in JP-A-1-158426.

(4) In tabular grains and regular crystal grains having a grain structure, dislocation lines as described in JP-A-3-237450 were observed using a high voltage electron microscope.

(5) Emulsions A-N contained iridium in the interior of each grain by the method described in B. H. Carroll, Photographic Science and Engineering, 24, 265 (1980).

The substances used in Sample 101 are indicated below:

UV-1
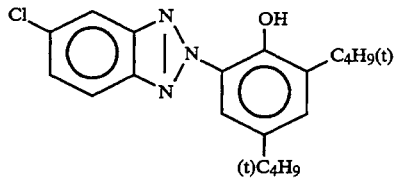
UV-2
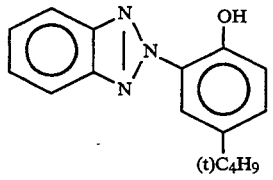
UV-3
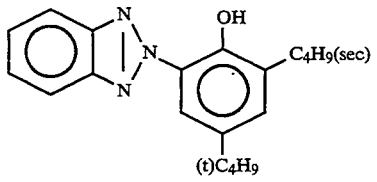
UV-4
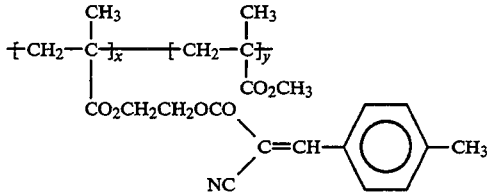
x:y = 70:30 (wt %)
UV-5
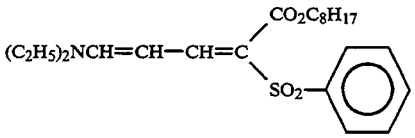
ExC-1
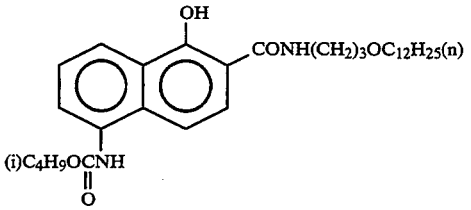
(the same as the exemplified compound Cp-(39))
ExC-2
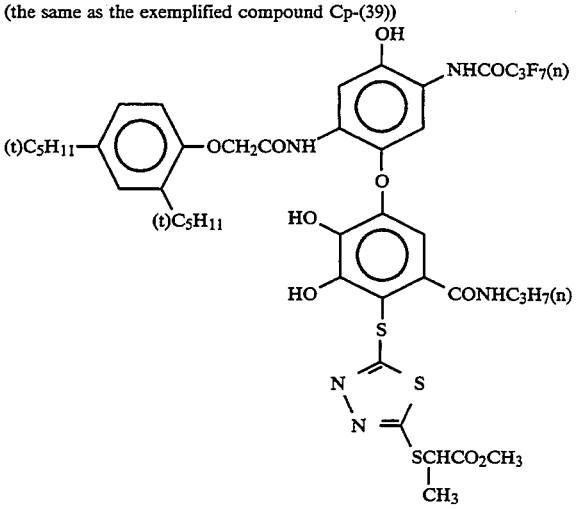

-continued
ExC-3
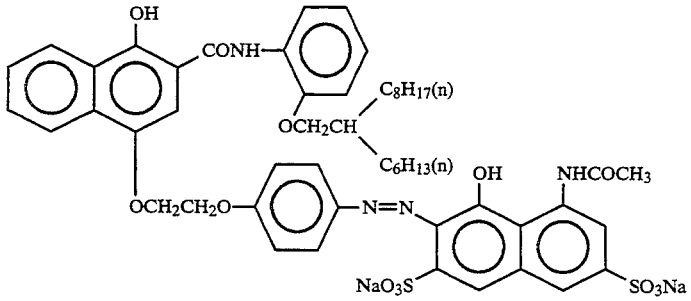
ExC-4
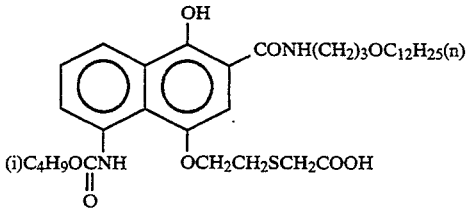
ExC-5
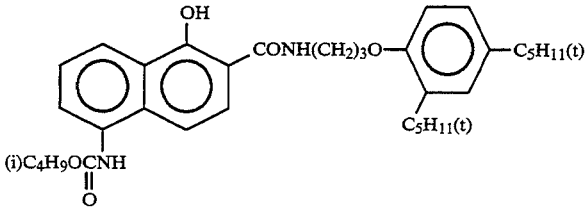
(the same as the exemplified compound YC-12)
ExC-6
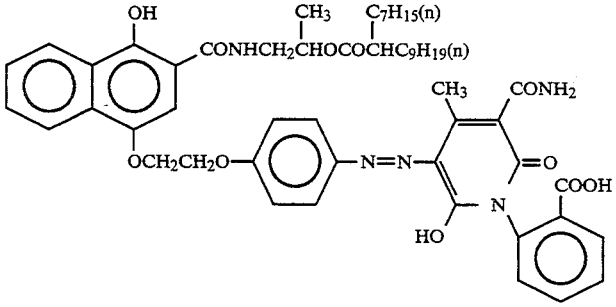
ExC-7
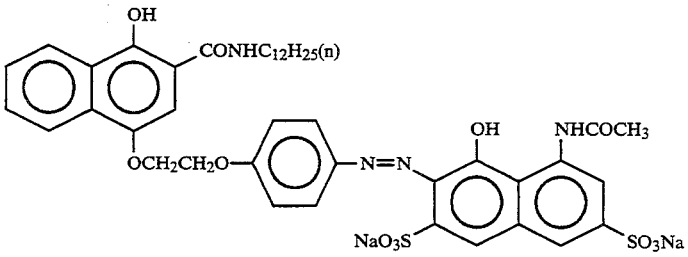
ExC-8
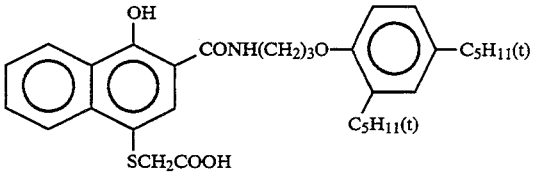
(the same as the exemplified compound Cp-(35))
ExC-9

-continued
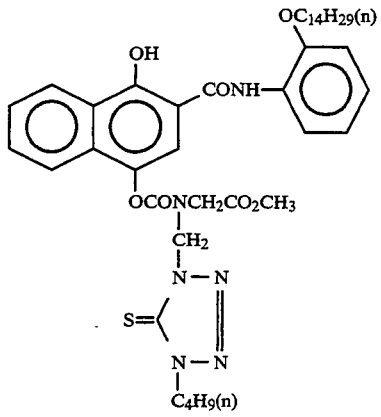
ExM-1
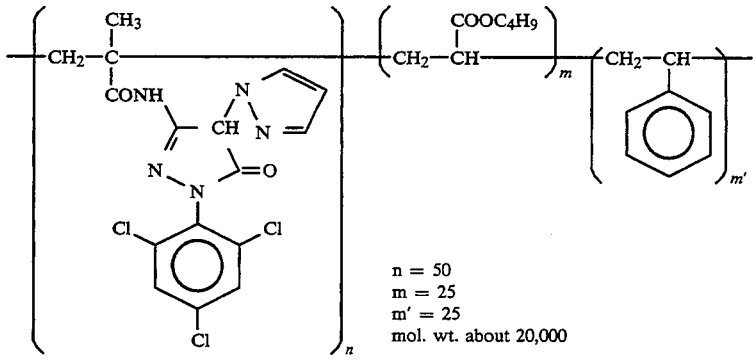
n = 50
m = 25
m' = 25
mol. wt. about 20,000
ExM-2
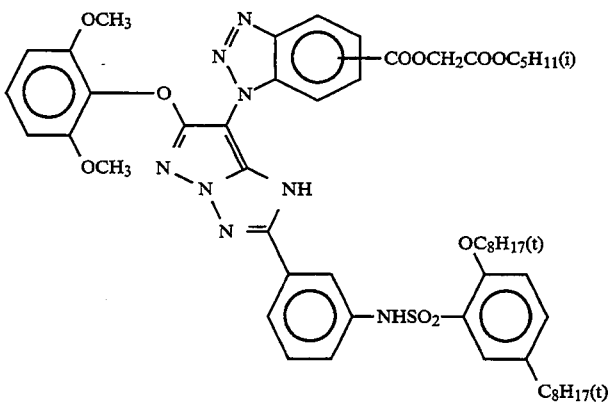
ExM-3
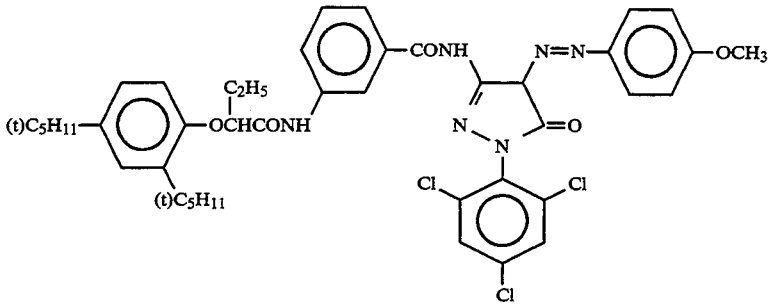

-continued
ExM-4
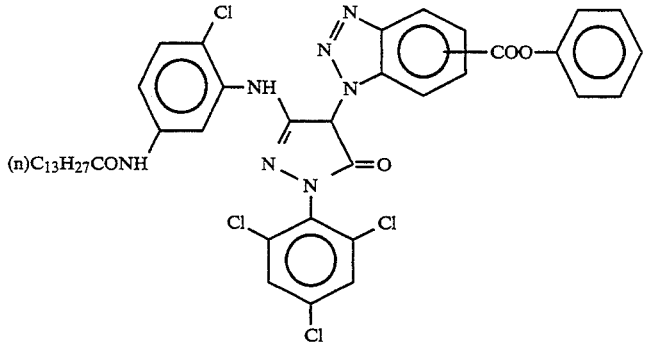
ExM-5
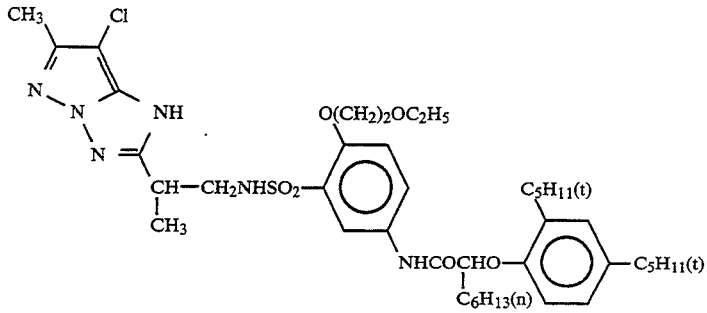
ExM-6
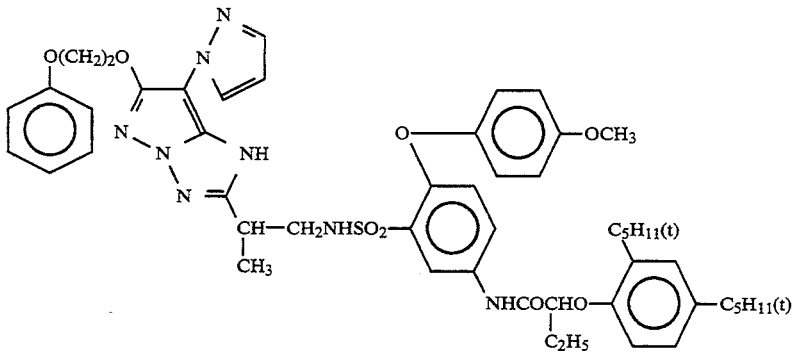
ExM-7
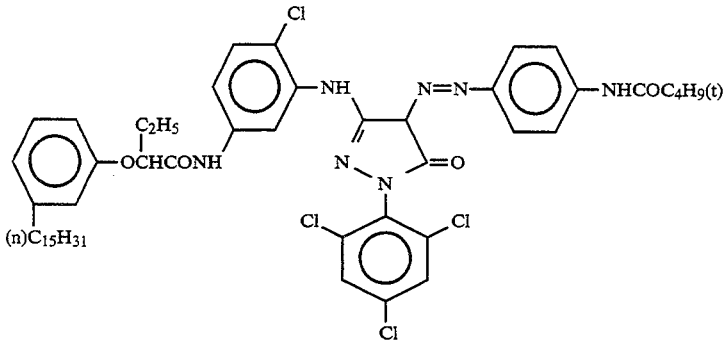
ExY-1
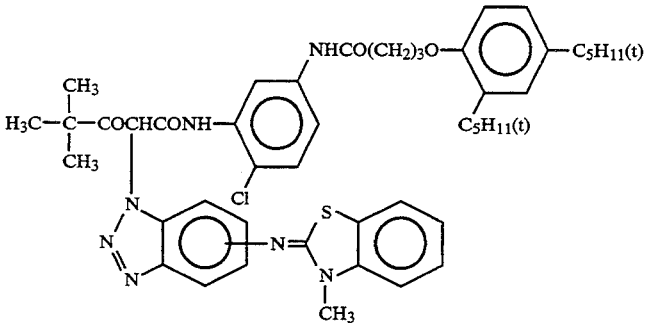

-continued
ExY-2
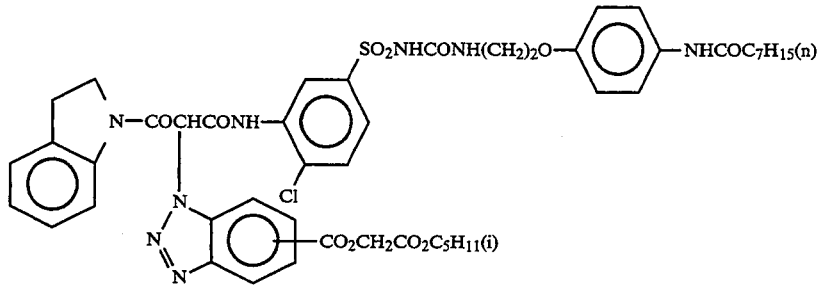
(the same as the exemplified compound Y12; and the same as YB-16 used in sample 7 described in Example 1 of JP-A-3-265845)
ExY-3
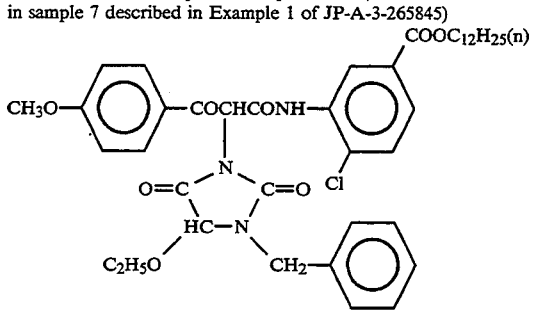
ExY-4
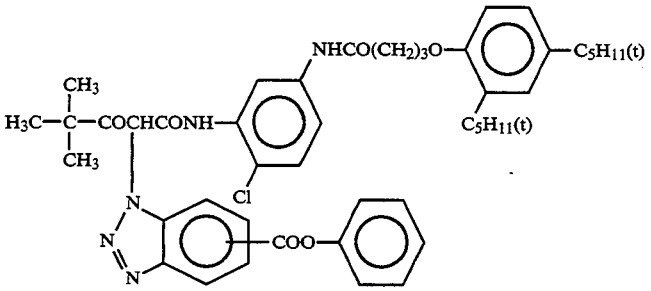
(the same as the exemplified compound Y-2-2)
ExY-5
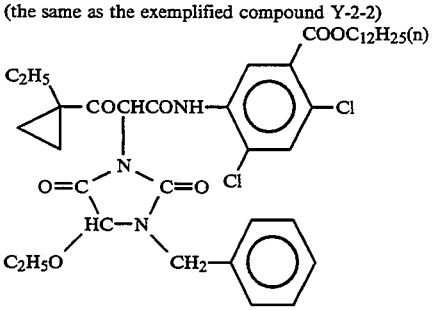
Cpd-1
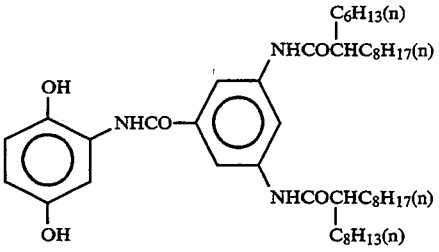
Cpd-2
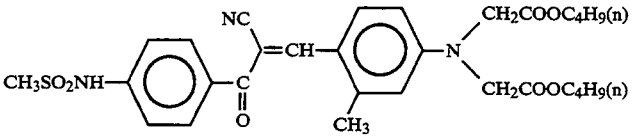

-continued
Cpd-3
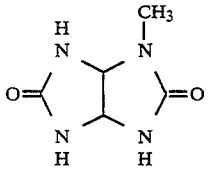
Cpd-4
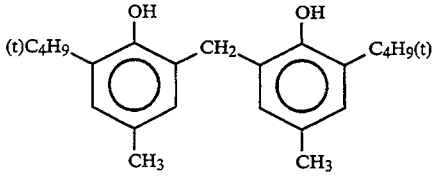
Cpd-5
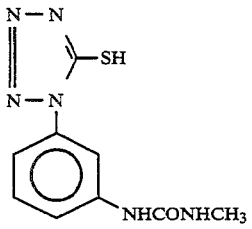
Cpd-6
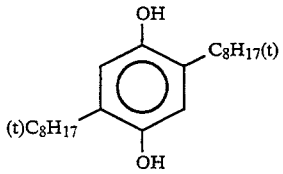
Solv-1
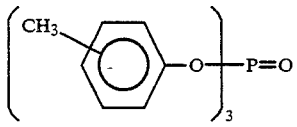
Solv-2
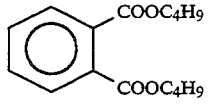
Solv-3
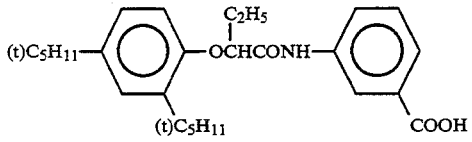
Solv-4
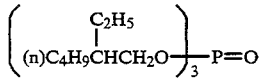
Solv-5
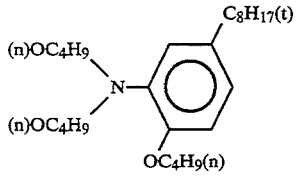

-continued
ExS-1
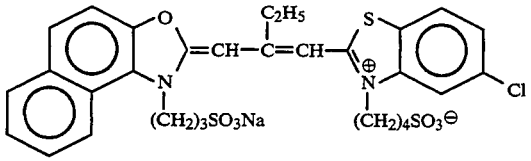
ExS-2
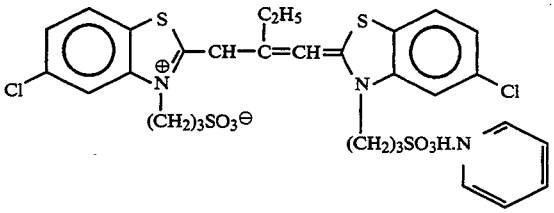
ExS-3
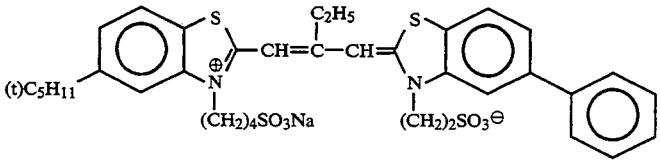
ExS-4
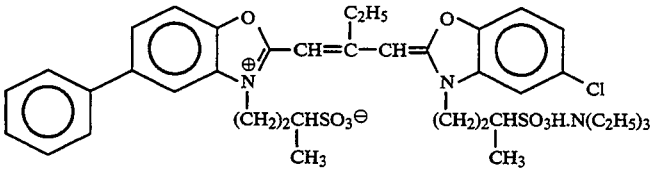
ExS-5
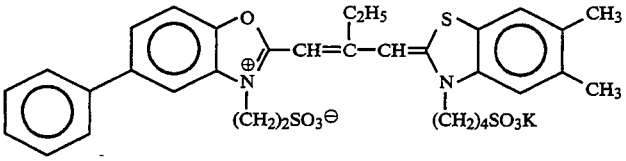
ExS-6
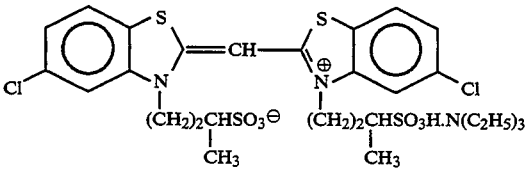
ExS-7
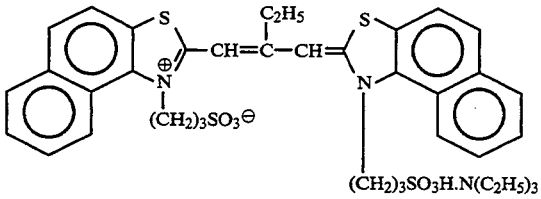
ExS-8
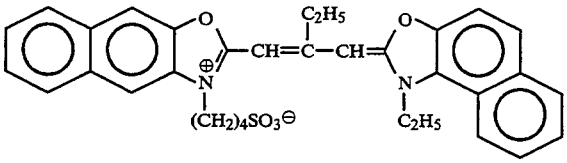
H-1
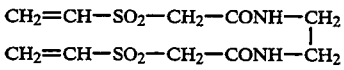

-continued
W-1
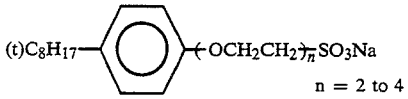
n = 2 to 4
W-2
$C_8F_{17}SO_2NHCH_2CH_2CH_2OCH_2CH_2\overset{\oplus}{N}(CH_3)_3$
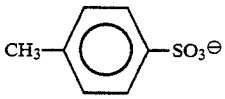
W-3
$(n)C_4H_9CH(C_2H_5)CH_2COOCH_2$
$(n)C_4H_9CH(C_2H_5)CH_2COOCHSO_3Na$
W-4
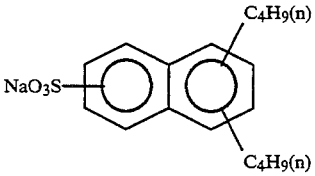
W-5
$C_8F_{17}SO_2N(C_3H_7)CH_2COOK$
W-6
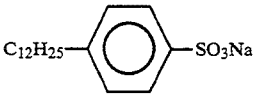
B-1
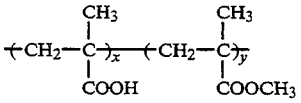
x/y = 10/90
B-2
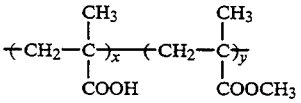
x/y = 40/60
B-3
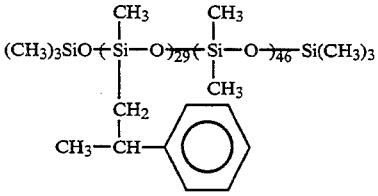
B-4
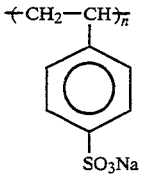
B-5
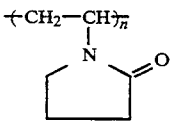
(mol. wt. about 10,000)

-continued
B-6
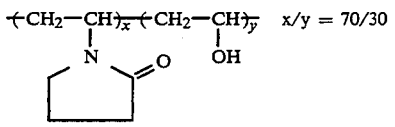
F-1
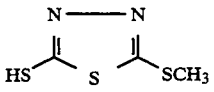
F-2
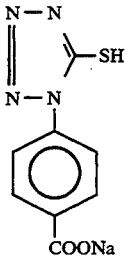
F-3
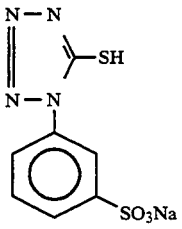
F-4
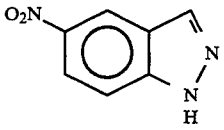
F-5
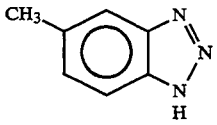
F-6
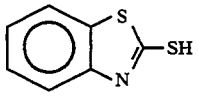
F-7
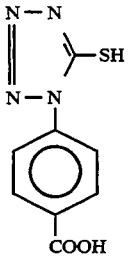
F-8
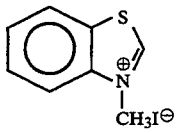

-continued

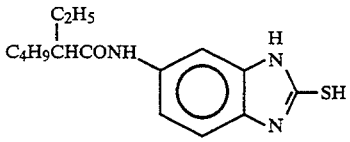

F-9

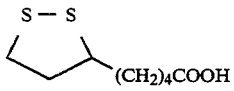

F-10

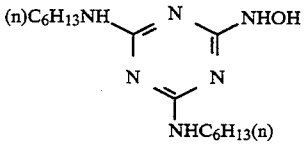

F-11

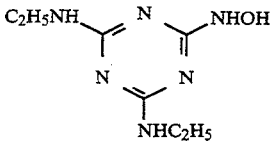

F-12

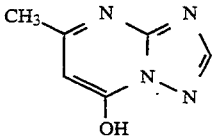

F-13

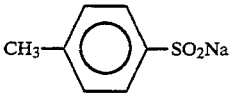

F-14

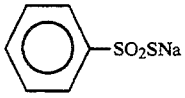

F-15

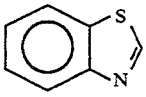

F-16

Preparation of Sample 102

A sample 102 was prepared in the same manner as the sample 101 except that $2.8\times10^{-2}$ of ExC-6, and $2.2\times10^{-2}$ of ExC-6 were added to the layers 2 and 3, respectively.

Preparation of Sample 103

A sample 103 was prepared in the same manner as the sample 102 except that $1.0\times10^{\times2}$ of ExC-6 was added to the layer 4.

Preparation of Sample 104

A sample 104 was prepared in the same manner as the sample 101 except that $1.5\times10^{-2}$ of ExY-3 was added to the layers 4.

Preparation of Sample 105

A sample 105 was prepared in the same manner as the sample 101 except that $4.2\times10^{-2}$ of ExY-3 was added to the layer 2, and $3.3\times10^{-2}$ of ExY-3 was added to the layer 3.

Preparation of Sample 106

A sample 106 was prepared in the same manner as the sample 105 except that $1.5\times10^{-2}$ of ExY-3 was added to the layer 4.

Preparation of Sample 107

A sample 107 was prepared in the same manner as the sample 101 except that $1.5\times10^{-2}$ of ExY-3, $3.2\times10^{-2}$ of ExC-6, and $2.5\times10^{-2}$ of ExC-6 were added to the layers 4, 2 and 3, respectively.

Preparation of Sample 108

A sample 108 was prepared in the same manner as the sample 107 except that ExY-3 was removed from the layer 4, and $1.6\times10^{-2}$ of ExY-5 was added therefor.

Preparation of Sample 109

A sample 109 was prepared in the same manner as the sample 107 except that ExC-6 in each of the layers 2 and 3 was changed to the exemplified compound (YC-1).

Preparation of Sample 110

A sample 110 was prepared in the same manner as the sample 101 except that $4.2\times10^{-2}$ of ExY-3, $3.3\times10^{-2}$ of ExY-3, and $1.0\times10^{-2}$ of ExC-6 were added to the layers 2, 3 and 4, respectively.

Samples 101 to 110 thus prepared were evaluated as follows:

Each of the samples 101 to 110 was exposed to white light through a silver wedge, and then subjected to the following development process. Densities were obtained as the status M density of each of blue, green, and red, and from the characteristic curve, the sensitivity of each sample was obtained. The sensitivity was expressed by a reciprocal of the exposure amount required to give a density of fog+0.3, with that of sample 100 assumed 100. Further, the sharpness of each sample at 10 cycle/mm was obtained by the general MTF method.

Next, using the samples 101 to 110, from-the-waist-up portrait photographs of a woman were taken. The camera used was EOS-10 of Canon. After the above-mentioned processing was performed, print samples were formed using Automatic Color Printer FAP 3500 of FUJI PHOTO FILM as a printer, and Fuji Color Super FA Paper of FUJI PHOTO FILM as a print material.

The print samples were evaluated by ten male and ten female observers.

The results are indicated in Table 2 below.

The development process was carried out in the following manner.

1. Color development . . . 3 min 15 sec, 38.0° C.±0.1° C.
2. Bleaching . . . 6 min 30 sec, 38.0° C.±3.0° C.
3. Water-washing . . . 3 min 15 sec, 24°–41° C.
4. Fixing . . . 6 min 30 sec, 38.0° C.±3.0° C.
5. Water-washing . . . 3 min 15 sec, 24°–41° C.
6. Stabilization . . . 3 min 15 sec, 38.0° C.±3.0° C.
7. Drying . . . 50° C. or lower The compositions of the respective processing solutions used in each step were as follows:

| | |
|---|---|
| Color Development Solution | |
| Diethylenetriaminepentaacetic acid | 1.0 g |
| 1-hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N-ethyl-N-β-hydroxyethylamino)-2-methylaniline sulfate | 4.5 g |
| Water to make | 1.0 liter |
| pH | 10.05 |
| Bleach solution | |
| Ammonium Fe(III) ethylenediaminetetraacetate | 100.0 g |
| Disodium ethylenediaminetetraacetate | 10.0 g |
| Ammonium bromide | 150.0 g |
| Ammonium nitrate | 10.0 g |
| Water to make | 1.0 liter |
| pH | 6.0 |
| Fixing solution | |
| Disodium ethylenediaminetetraacetate | 1.0 g |
| Sodium sulfite | 4.0 g |
| Ammonium thiosulfate aqueous solution (70%) | 175.0 ml |
| Sodium bisulfite | 4.6 g |
| Water to make | 1.0 liter |
| pH | 6.6 |
| Stabilizing Solution | |
| Formalin (40%) | 2.0 ml |
| Polyoxyethylene-p-monononylphenyl ether (av. polymerization degree: 10) | 0.3 g |
| Water to make | 1.0 liter |

TABLE 2

| Sample No. | Sensitivity of blue-sensitive layer | MTF sharpness of green sensitive layer [10 c/mm] | Evaluation of printing quality* | |
|---|---|---|---|---|
| 101 | 100 | 100 | 3.0 | comparative example |
| 102 | 95 | 108 | 3.9 | comparative example |
| 103 | 84 | 110 | 3.7 | comparative example |
| 104 | 105 | 94 | 2.8 | comparative example |
| 105 | 100 | 92 | 2.6 | comparative example |
| 106 | 106 | 88 | 2.4 | comparative example |
| 107 | 104 | 110 | 4.5 | Present invention |
| 108 | 106 | 113 | 4.7 | Present invention |
| 109 | 104 | 109 | 4.5 | Present invention |
| 110 | 89 | 97 | 2.6 | Comparative Example |

*The Printing quality is indicated by an averaged evaluation score based on the following scoring system:
1 . . . poor,
2 . . . slightly poor,
3 . . . average,
4 . . . good,
5 . . . very good As can be understood from Table 2, satisfactory performances cannot be achieved by simply adding a yellow coupler (JP-A-3-265845) or a yellow colored cyan coupler to the red-sensitive layer, but the sensitivity, sharpness, and printing quality can be upgraded by the the present invention, which appears to be contradictory, i.e. a yellow coupler is added along with a cyan coupler to the highest sensitivity layer of the red-sensitive layers, and a yellow-colored cyan coupler is added along with a cyan coupler to a red-sensitive layer having a lower sensitivity.

EXAMPLE 2

Samples were prepared from the samples 101–110 in Example 1 by removing ExC-2 and ExC-9 from the layers 2 and 3, respectively, and were evaluated in a similar manner to that of Example 1. Results similar to those of Example 1 were obtained. However, the advantages of the invention were more significant in Example 1 than Example 2, and it was found that a compound releasing a diffusing development inhibitor should preferably be contained in a red-sensitive silver halide emulsion layer having a lower sensitivity.

EXAMPLE 3

Each of the samples 101–110 of Example 1 was formed into the form of "UTSURUNDESU FLASH" (film unit equipped with a lens) of FUJI PHOTO FILM CO., and photographs of the same type as Example 1 were taken by use of each film unit, in place of EOS10 of Example 1, and evaluated.

In this example, the samples of the present invention exhibited a good printing quality, indicating a significant advantage.

What is claimed is:

1. A silver halide color photographic light-sensitive material comprising, on a support, at least one green-sensitive silver halide emulsion layer containing a magenta coupler, at least one blue-sensitive silver halide emulsion layer containing a yellow coupler, and at least two red-sensitive silver halide emulsion layers each containing a cyan coupler and having different sensitivities, wherein a highest sensitivity red-sensitive emulsion layer of said red-sensitive silver halide emulsion layers contains a yellow coupler, and a red-sensitive emulsion layer having a lower sensitivity than that of said highest sensitivity red-sensitive emulsion layer contains a yellow-colored cyan coupler.

2. The light-sensitive material according to claim 1, wherein a red-sensitive silver halide emulsion layer having a lower sensitivity contains at least one DIR compound which releases a diffusible development inhibitor or a precursor thereof upon reacting with an oxide form of a developing agent, or which cleaves to form another compound after reacting with an oxidized form of a developing agent, which cleaved compound in turn reacts with another molecule of the oxide form of the developing agent to release a development inhibitor.

3. The light-sensitive material according to claim 1, wherein said yellow coupler contained in the highest-sensitivity red-sensitive silver halide emulsion layer is represented by Formula (Y) below:

Formula (Y)

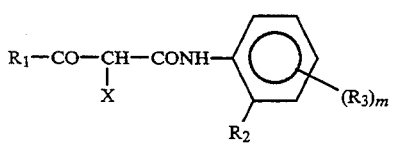

where $R_1$ represents a tertiary alkyl group, or an aryl group; $R_2$ represents a hydrogen atom, a halogen atom, an alkoxy group, an aryloxy group, an alkyl group, or a dialkylamino group; $R_3$ represents a group which can be substituted on the benzene ring; X represents a hydrogen atom, or a group which can be split off upon coupling with an oxidized form of an aromatic primary amine developing agent; and m represents an integer of 0 to 4, and if m is 2, 3 or 4, groups $R_3$ may be the same or different.

4. The light-sensitive material according to claim 3, wherein said yellow coupler of Formula (Y) is contained in an amount of 0.05 to 0.08 g/m$^2$.

5. The light-sensitive material according to claim 3, wherein said yellow coupler of Formula (Y) is contained in an amount of 0.10 to 0.50 g/m$^2$.

6. The light-sensitive material according to claim 1, wherein said yellow-colored cyan coupler represented by Formula (CI), (CII), (CIII) or (CIV) below:

Formula (CI)

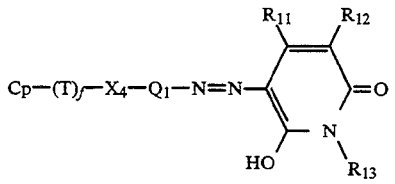

-continued

Formula (CII)

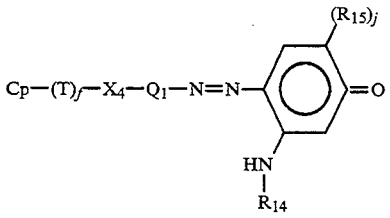

Formula (CIII)

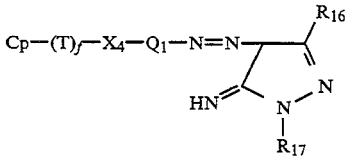

Formula (CIV)

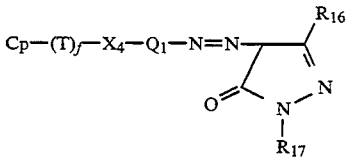

where in formulas (CI) to (CIV), Cp represents a cyan coupler residue; T represents a timing group bonded to the coupling position of Cp; f represents an integer of 0 or 1; $X_4$ represents a divalent linking group containing N, O or S through which it is bonded to $(T)_f$, and bonding to $Q_1$; and $Q_1$ represents an arylene group or a divalent heterocyclic group;

in formula (CI), each of $R_{11}$ and $R_{12}$ independently represents a hydrogen atom, a sulfo group, a cyano group, an alkyl group, a cycloalkyl group, an aryl group, a heterocyclic group, a carbamoyl group, a carbonamido group, a sulfonamido group, or an alkylsulfonyl group; and $R_{13}$ represents a hydrogen atom, an alkyl group, an aryl group, or a heterocyclic group; wherein at least one of T, $X_4$, $Q_1$, $R_{11}$, $R_{12}$ and $R_{13}$ contains a water-soluble group;

in formula (CII), $R_{14}$ represents an acyl group or a sulfonyl group; $R_{15}$ represents a group substitutable on the benzene ring; j represents an integer of 0 to 4, and if j is 2 or more, 2 or more $R_{15}$ groups may be the same or different, wherein at least one of T, $X_4$, $Q_1$, $R_{14}$ and $R_{15}$ contains a water-soluble group; and in formulas (CIII) and (CIV), $R_{16}$ represents a hydrogen atom, a carboxyl group, a sulfo group, a cyano group, an alkyl group, a cycloalkyl group, an aryl group, an alkoxy group, a cycloalkyloxy group, an aryloxy group, a heterocyclic group, a carbamoyl group, a sulfamoyl group, a carbonamido group, a sulfonamido group, or an alkylsulfonyl group; and $R_{17}$ represents a hydrogen atom, an alkyl group, a cycloalkyl group, an aryl group, or a heterocyclic group, wherein at least one of T, $X_4$, $Q_1$, $R_{16}$, and $R_{17}$ contains a water-soluble group.

7. The light-sensitive material according to claim 6, wherein said yellow-colored cyan coupler is contained in an amount of 0.005 to 0.30 g/m$^2$.

8. The light-sensitive material according to claim 6, wherein said yellow-colored cyan coupler is contained in an amount of 0.02 to 0.20 g/m$^2$.

9. The light-sensitive material according to claim 6, wherein said yellow-colored cyan coupler is contained in an amount of 0.03 to 0.15 g/m$^2$.

10. The light-sensitive material according to claim 2, wherein said DIR compound is represented by Formula (XI) or (XII) below:

$$A\text{-}(TIME)_a\text{-}DI \qquad \text{Formula(XI)}$$

$$A\text{-}(TIME)_i\text{-}RED\text{-}DI \qquad \text{Formula(XII)}$$

where A represents a group which splits off $(TIME)_a$-DI or $(TIME)_i$-RED-DI upon reaction with an oxidized form of an aromatic primary amine color developing agent; TIME represents a timing group which cleaves DI or RED-DI after released from A; RED represents a group which cleaves DI by reacting with an oxidized form of a developing agent after released from A or TIME; DI represents a development inhibitor; a is 0, 1, or 2, and i is 0 or 1, and when a is two, two TIMEs may be the same or different.

11. The light-sensitive material according to claim 1, wherein said DIR compound is contained in an amount 0.005 to 0.200 g/m$^2$.

12. The light-sensitive material according to claim 1, wherein said DIR compound is contained in an amount of 0.005 to 0.100 g/m$^2$.

13. The light-sensitive material according to claim 1, wherein said DIR compound is contained in an amount of 0.010 to 0.040 g/m$^2$.

* * * * *